US006484656B2

(12) United States Patent
Mears et al.

(10) Patent No.: US 6,484,656 B2
(45) Date of Patent: Nov. 26, 2002

(54) AUTOMATIC INFLATING BOAT FLOTATION DEVICE

(75) Inventors: Arthur W. Mears, Longmont, CO (US); Richard S. Coate, Fort Collins, CO (US)

(73) Assignee: Float Rail, Inc., Boulder, CO (US)

( * ) Notice: Subject to any disclaimer, the term of this patent is extended or adjusted under 35 U.S.C. 154(b) by 0 days.

(21) Appl. No.: 09/832,774

(22) Filed: Apr. 10, 2001

(65) Prior Publication Data

US 2002/0026888 A1 Mar. 7, 2002

Related U.S. Application Data

(60) Provisional application No. 60/207,996, filed on May 26, 2000.

(51) Int. Cl.[7] ..... B63C 9/04

(52) U.S. Cl. ..... 114/68; 114/123; 114/360

(58) Field of Search ..... 114/68, 69, 123, 114/219, 345, 348, 360; 441/40, 66

(56) References Cited

U.S. PATENT DOCUMENTS

| | | | | |
|---|---|---|---|---|
| 151,400 A | | 5/1874 | Keeler et al. | |
| 980,790 A | | 1/1911 | Johnson | |
| 1,038,928 A | | 9/1912 | Menzel | |
| 1,133,629 A | * | 3/1915 | Foster | 114/68 |
| 1,220,876 A | | 3/1917 | Moore | |
| 1,249,633 A | | 12/1917 | Jelercic | |
| 1,622,508 A | | 3/1927 | Harper | |
| 2,924,192 A | * | 2/1960 | Salvage | 114/68 |
| 3,822,662 A | * | 7/1974 | Morita et al. | 114/68 |
| 4,389,961 A | * | 6/1983 | Parish | 114/345 |
| 4,458,618 A | | 7/1984 | Tuffier | 114/68 |
| 4,495,880 A | | 1/1985 | Maniscalco et al. | 114/123 |
| 4,667,618 A | | 5/1987 | Cigognetti | 114/345 |
| 4,817,555 A | | 4/1989 | Meinen | 114/360 |
| 4,864,961 A | | 9/1989 | Slonski | 114/360 |
| 4,867,094 A | | 9/1989 | Binks | 114/359 |
| 4,996,936 A | | 3/1991 | Brundritt | 114/68 |
| 5,215,031 A | | 6/1993 | Inman et al. | 114/360 |
| 5,357,888 A | | 10/1994 | Insinna | 114/69 |

FOREIGN PATENT DOCUMENTS

DE 3530618 A1 3/1987

* cited by examiner

*Primary Examiner*—S. Joseph Morano
*Assistant Examiner*—Lars A. Olson
(74) *Attorney, Agent, or Firm*—Emery L. Tracy

(57) ABSTRACT

A flotation device for maintaining a watercraft in a floating condition is provided. The flotation device comprises an elongated housing mounted to the watercraft. A carrier is slidably received within the housing with the carrier having a first and second cover channel and a bladder retaining slot. A first collapsible tubing is receivable within the first cover channel. An elongated cover is releasably secured within the first cover channel and the second cover channel. A space is defined between the carrier and the cover. A flotation bladder is receivable within the space with the flotation bladder having a bladder edge receivable in the bladder retaining slot. An inflation mechanism is connected to the first collapsible tubing and the flotation bladder for inflating the first collapsible tubing and for inflating the flotation bladder wherein upon inflation of the first collapsible tubing, the cover is released from the first cover channel of the carrier and the flotation bladder moves the first edge of the cover in a direction generally away from the watercraft allowing the flotation bladder to substantially completely inflate.

23 Claims, 26 Drawing Sheets

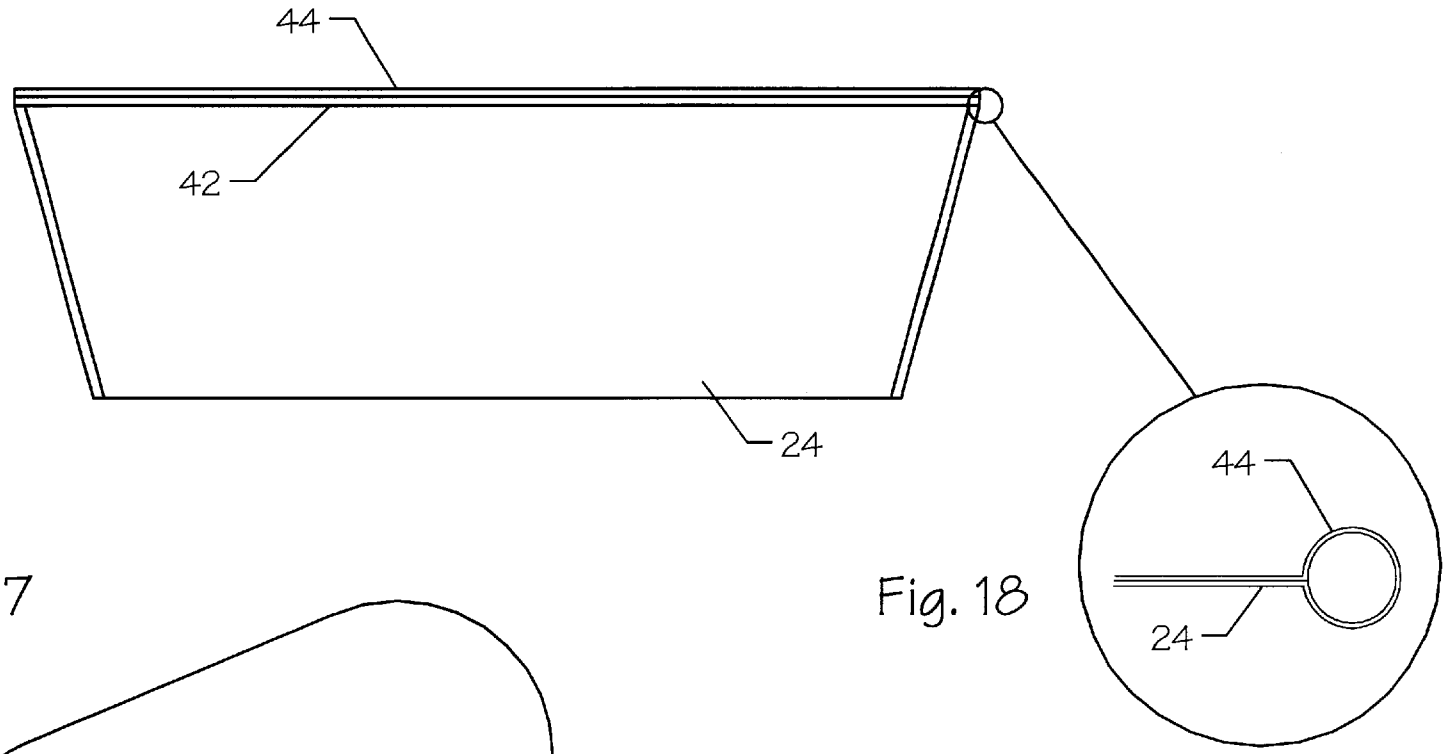
Fig. 16
Fig. 18
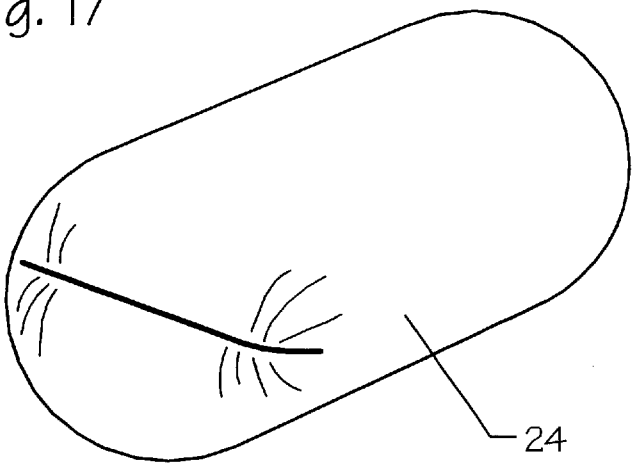
Fig. 17

AUTOMATIC INFLATING BOAT FLOTATION DEVICE

The present application is a continuation of pending provisional patent application Ser. No. 60/207,996, filed on May 26, 2000, entitled "Automatic Inflating Boat Flotation Device".

BACKGROUND OF THE INVENTION

1. Field of the Invention

The present invention relates to flotation devices for watercraft and, more particularly, it relates to an automatically inflating flotation device that would prevent a watercraft from sinking. The flotation device would automatically inflate when a predetermined amount of water entered the hold of the vessel.

2. Description of the Prior Art

Boating is both a popular pastime and a vital commercial activity in much of the world today. A boat is often a substantial investment for the owner. In the case of commercial boats, the boat is often the livelihood of the owner of the boat. As a general concept, boats sink when the hull of the boat takes on water and the boat loses its buoyancy. This can happen if the hull is breached due to a collision with some object or in heavy waves if the boat is swamped.

A number of patents have been directed to inventions to prevent a boat from sinking, even if the hull was breached. Unfortunately, the previous devices for boat floatation have a number of problems such as being difficult to install and often require manual activation of the device. This is a major concern since many boats often sink unattended at the dock, not out on the open water.

The flotation device of the present invention solves these problems and others by being easy to install, either as a retrofit to an existing boat or during manufacture of the boat. In addition, the flotation device of the present invention is designed to automatically deploy when a pre-determined level of water is consistently in the hull of the vessel. The device will not deploy when water merely splashes to that level, preventing unneeded deployment in heavy seas. Once deployed the present invention will keep the boat afloat even if a complete flooding of the hull has occurred.

The primary aspect of the present invention is to provide an automatically deploying flotation device to keep the boat floating after water has partially filled the hull of the boat.

Another aspect of the present invention is to provide a flotation device that does not interfere with the looks or operation of the boat when not deployed.

Another aspect of the present invention is to provide for a flotation device that can be easily removed and a new one re-installed after deployment.

Another aspect of the present invention is to provide a device that is easy to manufacture and install.

SUMMARY

An automatically inflating boat rail is disclosed. An inflatable bag is rolled into a tight spiral. The spiral is mounted inside a one or more piece flexible housing. The base of the housing is mounted to the outside of the hull. The base of the bag is attached to the base of the housing. The outer part of the housing is removably attached to the base of the housing, enclosing the rolled bag. One or more bags can be mounted in the housing. The bag has valves that are attached to safety valves. The safety valve is triggered by water in the hull reaching a given height in the hull. Once the safety valve is triggered, tanks of compressed inert gas are released into the system. The outer part of the housing is pushed off and the bags inflate and unroll. The bags can have internal chambers so that one part can be punctured without deflating the whole system.

The present invention is a flotation device for maintaining a watercraft in a floating condition. The flotation device comprises an elongated housing mounted to the watercraft with the housing having a first cover channel, a second cover channel, and a bladder retaining slot. A first collapsible tubing is receivable within the first cover channel. An elongated cover having a first edge and a second edge is secured to the housing with the first edge releasably receivable in the first cover channel and the second edge releasably receivable in the second cover channel. A space is defined between the housing and the cover. A flotation bladder is receivable within the space with the flotation bladder having a bladder edge receivable in the bladder retaining slot. Inflation means are connected to the first collapsible tubing and the flotation bladder for inflating the first collapsible tubing and for inflating the flotation bladder upon inflation of the first collapsible tubing wherein upon inflation of the first collapsible tubing, the first edge of the cover is released from the first cover channel of the housing and wherein upon inflation of the flotation bladder, the flotation bladder moves the first edge of the cover in a direction generally away from the watercraft allowing the flotation bladder to substantially completely inflate.

In addition, the present invention includes an emergency buoyant support for a watercraft. The emergency buoyant support comprises a base plate mounted to the watercraft and a cover removably attached to the base plate. A storage channel is formed between the base plate and the cover and an inflatable bladder is spirally wrapped within the storage channel wherein upon inflation of the inflatable bladder, the bladder moves the cover allowing the bladder to inflate.

Furthermore, the present invention includes a method for maintaining a watercraft in a floating condition. The method comprises mounting a housing to the watercraft with the housing having a first cover channel, a second cover channel, and a bladder retaining slot, positioning a first collapsible tubing within the first cover channel, covering the housing with a cover with the cover having a first edge and a second edge, releasably mounting the first edge of the cover within the first cover channel and the second edge within the second cover channel, defining a space between the housing and the cover, positioning a flotation bladder within the space, the flotation bladder having a bladder edge, mounting the bladder edge of the flotation bladder within the bladder retaining slot, inflating the first collapsible tubing, and inflating the inflation bladder.

In an embodiment of the present invention, the method further comprises positioning a second collapsible tubing within the second cover channel and inflating the second collapsible tubing prior to inflating the inflation bladder.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

FIG. 16 is top perspective view illustrating the flotation bladder in a deflated condition;

FIG. 17 is a perspective view illustrating the flotation bladder in an inflated condition;

FIG. 18 is a sectional view illustrating the attachment edge of the flotation bladder taken along line A—A of FIG. 16;

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE PREFERRED EMBODIMENTS

Figure 1:
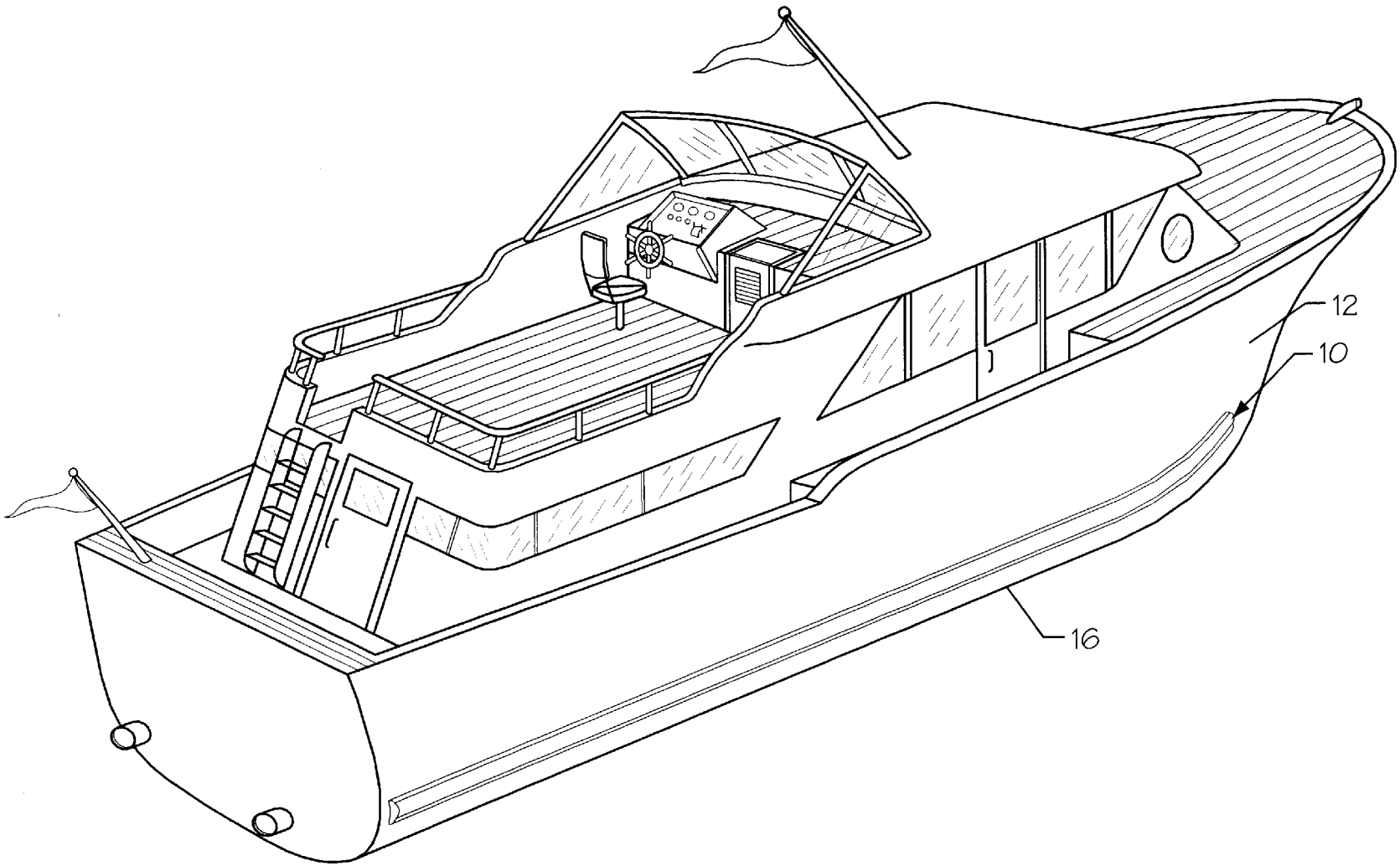
FIG. 1 is a perspective view illustrating a flotation device, constructed in accordance with the present invention, with the flotation device being mounted on a hull of a watercraft having a boat rail.
Figure 2:
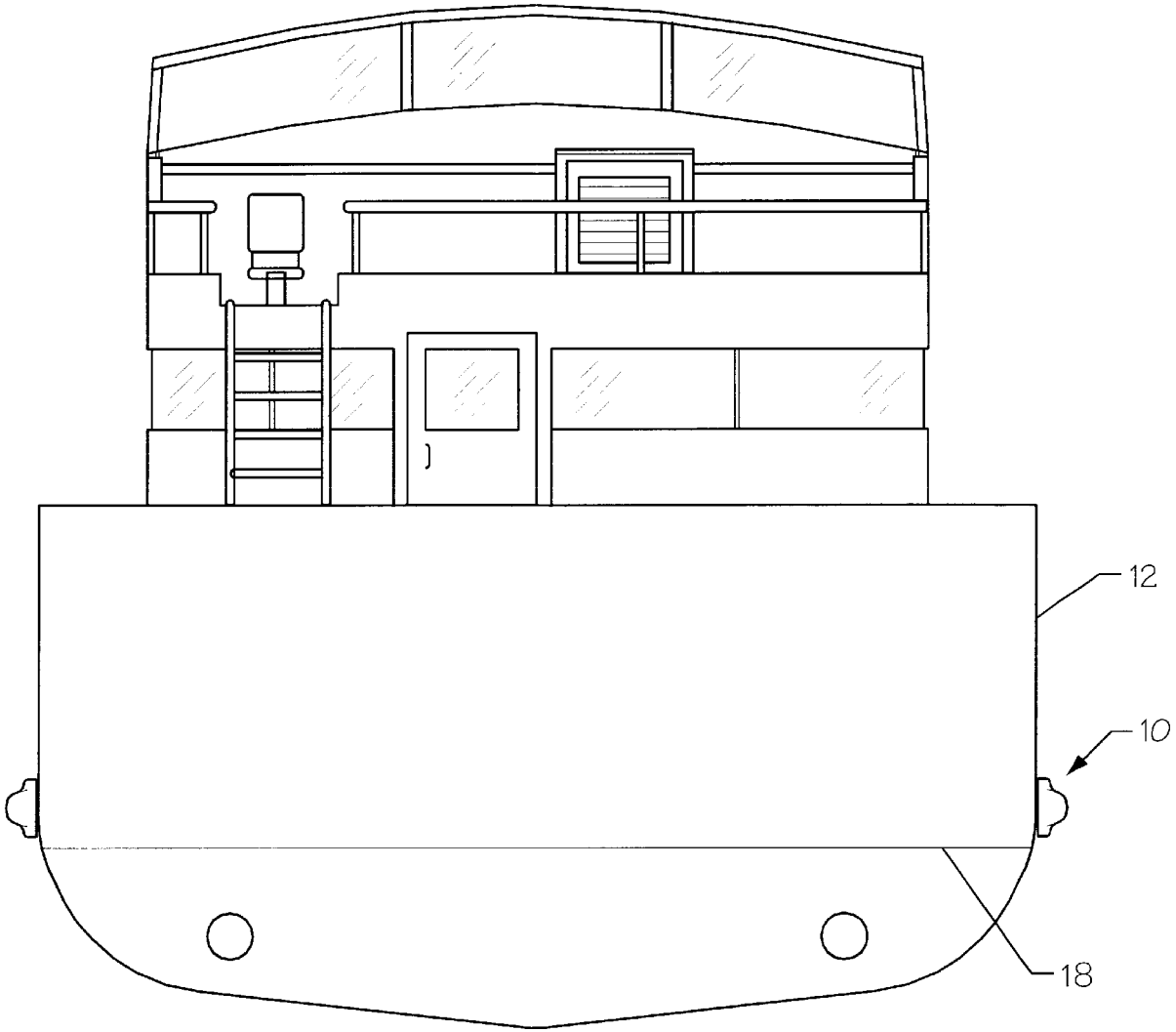
FIG. 2 is a rear view illustrating the flotation device, constructed in accordance with the present invention, with the flotation device mounted to the hull adjacent the waterline.

As illustrated in FIG. 1, the present invention is a flotation device, indicated generally at 10, for mounting to a watercraft 12 which automatically activates to maintain the watercraft in a floating condition. The flotation device 10 includes a mounting plate 14 preferably mounted on the exterior of the hull 16 of the watercraft 12. The mounting plate 14 and the cover 22 is the only portion of the flotation device 10 that is visible on the exterior of the watercraft 12. It is considered important that the mounting plate 14 have low profile and an unobtrusive visual presence, so that the mounting plate 14 does not significantly affect either the aerodynamic or visual lines of the watercraft 12 when not inflated. As illustrated in FIG. 2, the mounting plate 14 is mounted at approximately the water line 18 on the hull 16 of the watercraft 12.

Figure 3:
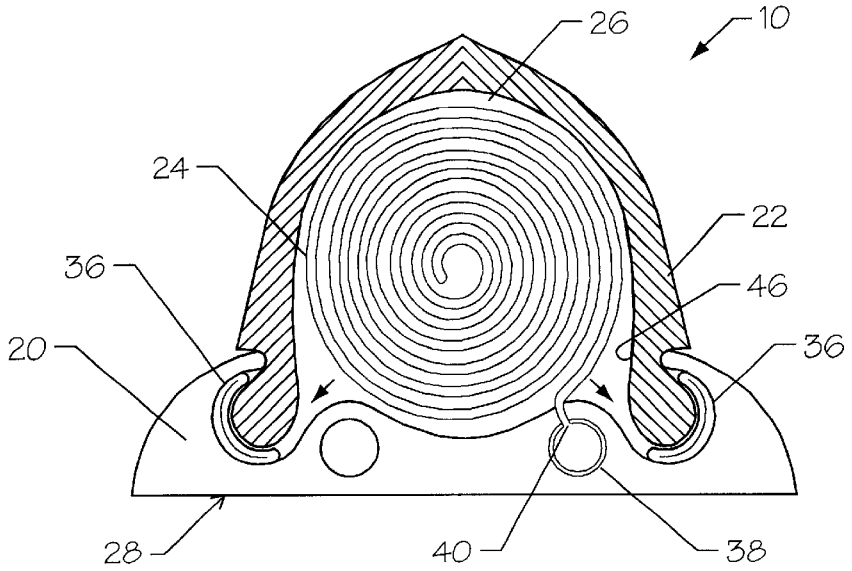
FIG. 3 is a sectional view illustrating an embodiment of the flotation device, constructed in accordance with the present invention.
Figure 4:
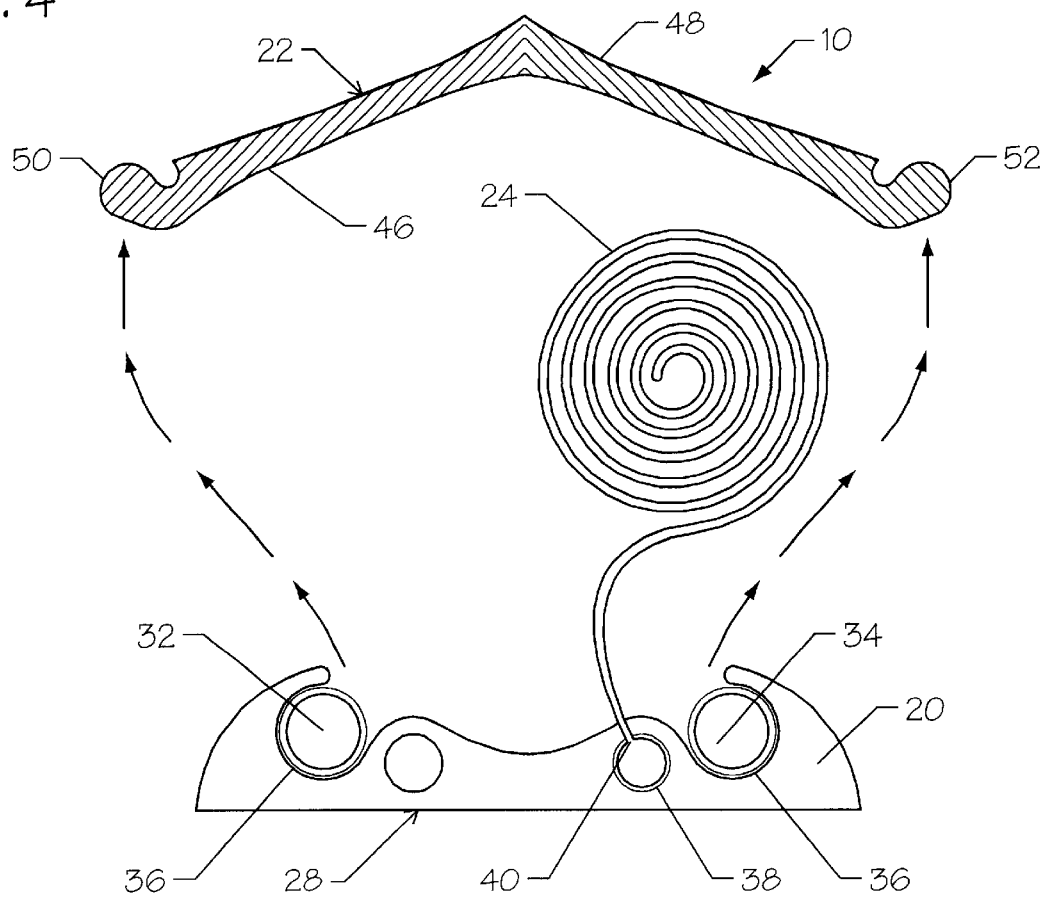
FIG. 4 is sectional view illustrating the flotation device of FIG. 3, constructed in accordance with the present invention, with the cover being removed prior to inflation.

As shown in FIGS. 3 and 4, in an embodiment flotation device 10 of the present invention, the mounting plate 14 has a carrier 20, a cover 22, and a deflated flotation bladder 24. The mounting plate 14 is preferably made from aluminum or similar material although constructing the mounting plate 14 from different types of material is within the scope of the present invention.

The flotation bladder 24 is folded to fit inside a space 26 formed between the carrier 20 and the cover 22. Preferably, the flotation bladder 24 is rolled into a spiral configuration. Furthermore, preferably, the flotation bladder 24 is made from urethane coated ballistic nylon although constructing the flotation bladder 24 from different types of material is within the scope of the present invention.

Figure 29:
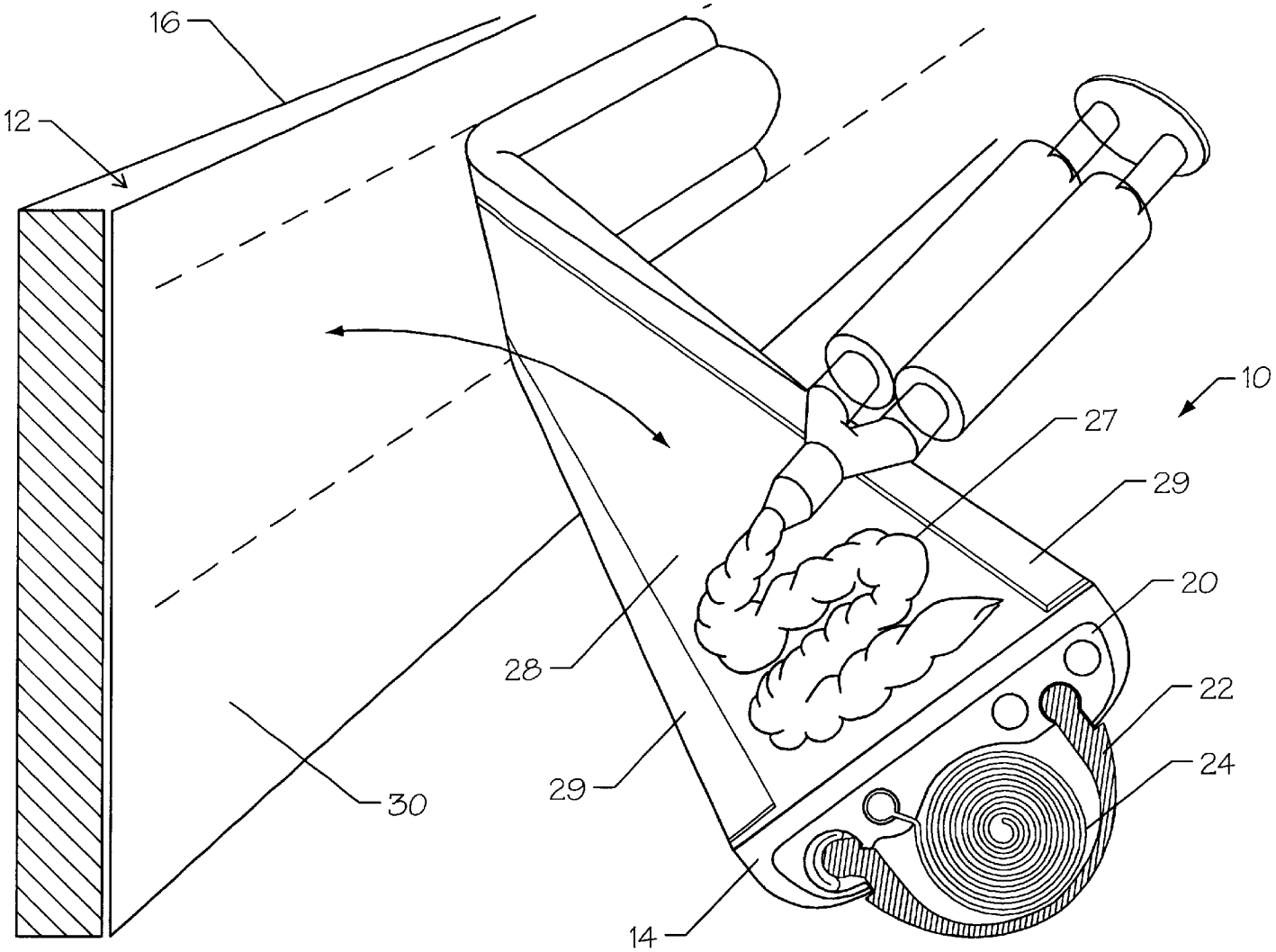
FIG. 29 is a perspective view illustrating the mounting of the flotation device to a watercraft.

The mounting plate 14 has a flat mounting surface 28 on one side which mounts directly to an attachment surface 30 of the hull 16 of the watercraft 12, as illustrated in FIG. 29. Preferably, the mounting plate 14 is mounted to the exterior of the watercraft hull 16 using either an adhesive for fiberglass and for metal hulls or screws for wood hulls (not shown). The preferred type of adhesive is a two-part epoxy 27. At least one strip 29 is positioned on the mounting plate 14 which maintains the mounting plate 14 to the hull 16 of the watercraft 12 while the two-part epoxy cures. The preferred brand of epoxy is DP 190, manufactured by Minnesota Mining and Manufacturing (3M), St. Paul, Minn. Screws (not shown) may be necessary on wooden hulled boats since some adhesive only sticks to the outermost layer of paint on the exterior of the hull 16.

The carrier 20 slides into and snaps into place within the mounting plate 14. The carrier 20 has two channels 32, 34 spaced apart from each other and extending axially along the length of the carrier 20. Placed in at least one of the channels 32, 34 is a flexible cover tubing 36. The cover tubing 36 is made from a flexible material so that the cover tubing 36 can be collapsed against itself as illustrated in FIGS. 3 and 7. When the cover tubing 36 is expanded it substantially fills the channels 32 and/or 34 as illustrated in FIGS. 4 and 7*a*–7*g*.

A bladder retaining slot 38 extends axially along the carrier 20 between the channels 32 and 34. The bladder retaining slot 38 has a narrowed neck 40 at the top if the bladder retaining slot 38. In the preferred embodiment, the bladder retaining slot 38 is substantially circular and about ½ inch in diameter. The bladder retaining slot 38 can have a larger diameter for retaining larger bladders required for heavier watercraft.

Figure 5:
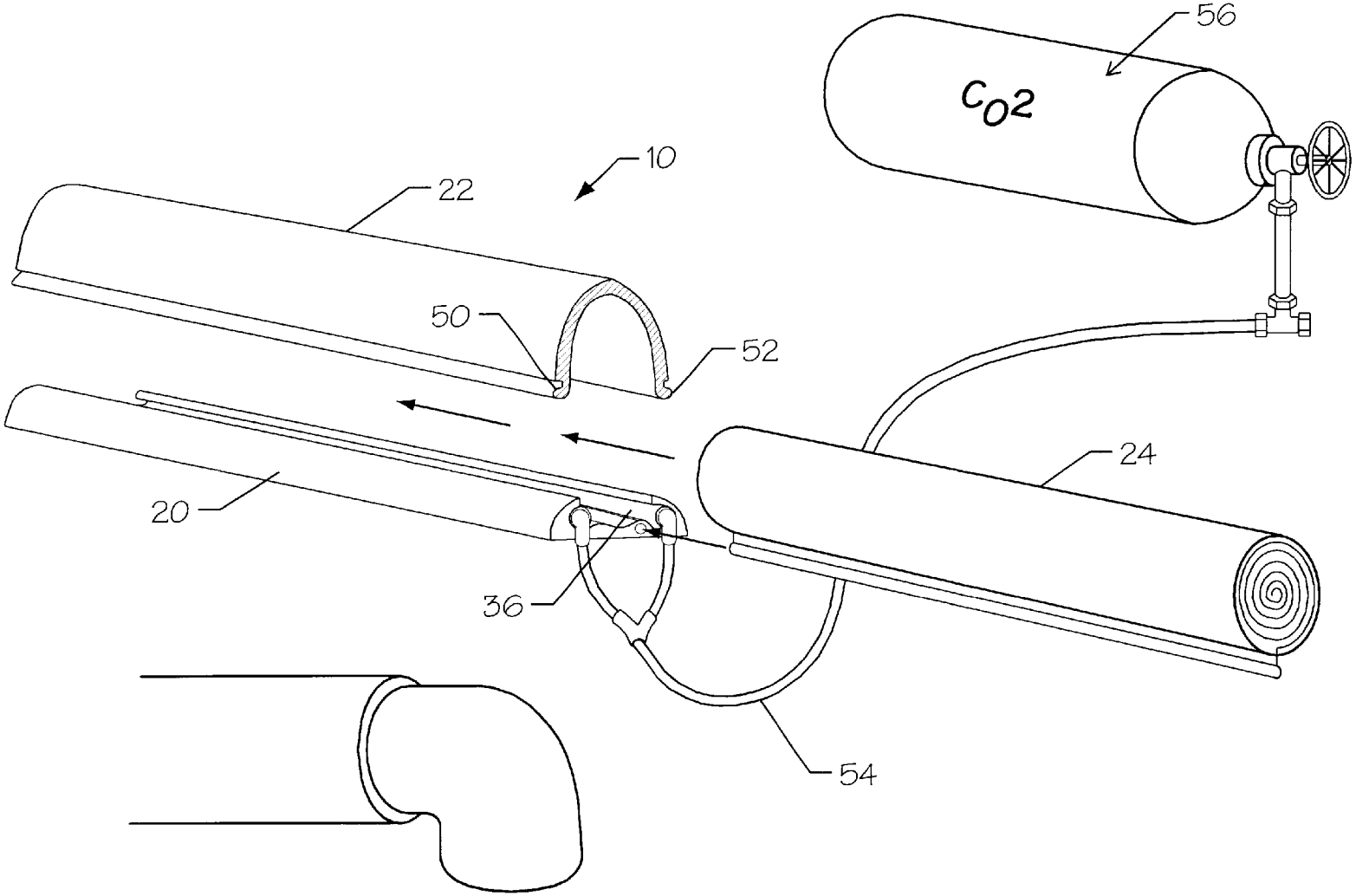
FIG. 5 is a partially exploded assembly perspective view illustrating the flotation device of FIG. 3, constructed in accordance with the present invention.

The flotation bladder 24 has one side 42 with an enlarged edge 44 along the length of the flotation bladder 24 as shown in FIG. 16 and in cross section in FIG. 18. The enlarged edge 42 has a rod or rope which fits inside the bladder retaining slot 38 and is held in place by the neck 40 as shown in FIGS. 5 and 7. The enlarged edge 44 and the rod are slid along the bladder retaining slot 38, attaching the flotation bladder 24 to the carrier 20.

The cover 22 has an interior surface 46, an exterior surface 48, and two hooked edges 50, 52 extending axially along the length of the cover 22. The hooked edges 50, 52 are shaped to fit in the channels 32, 34 on the carrier 20 over the flattened tubing 36, as shown in FIGS. 3 and 7*a*–7*g*. The cover 22 is attached to the carrier 20 by sliding the hooked edges 50, 52 in to the channels 32, 34 over the cover tubing 36 is attached at one end to a supply tubing 54 which is attached to a gas supply 56. The gas supply 56 preferably contains an inert, compressed gas such as $CO_2$.

The cover 22 must be made from a durable material as it is going to be exposed to the elements continuously. The cover 22 is preferably made from thermoplastic rubber. When the mounting plate 14 is mounted on the hull 16 of the watercraft 12 and the cover 22 is in place, the present invention functions as a bumper to protect the watercraft 12.

Figure 6:
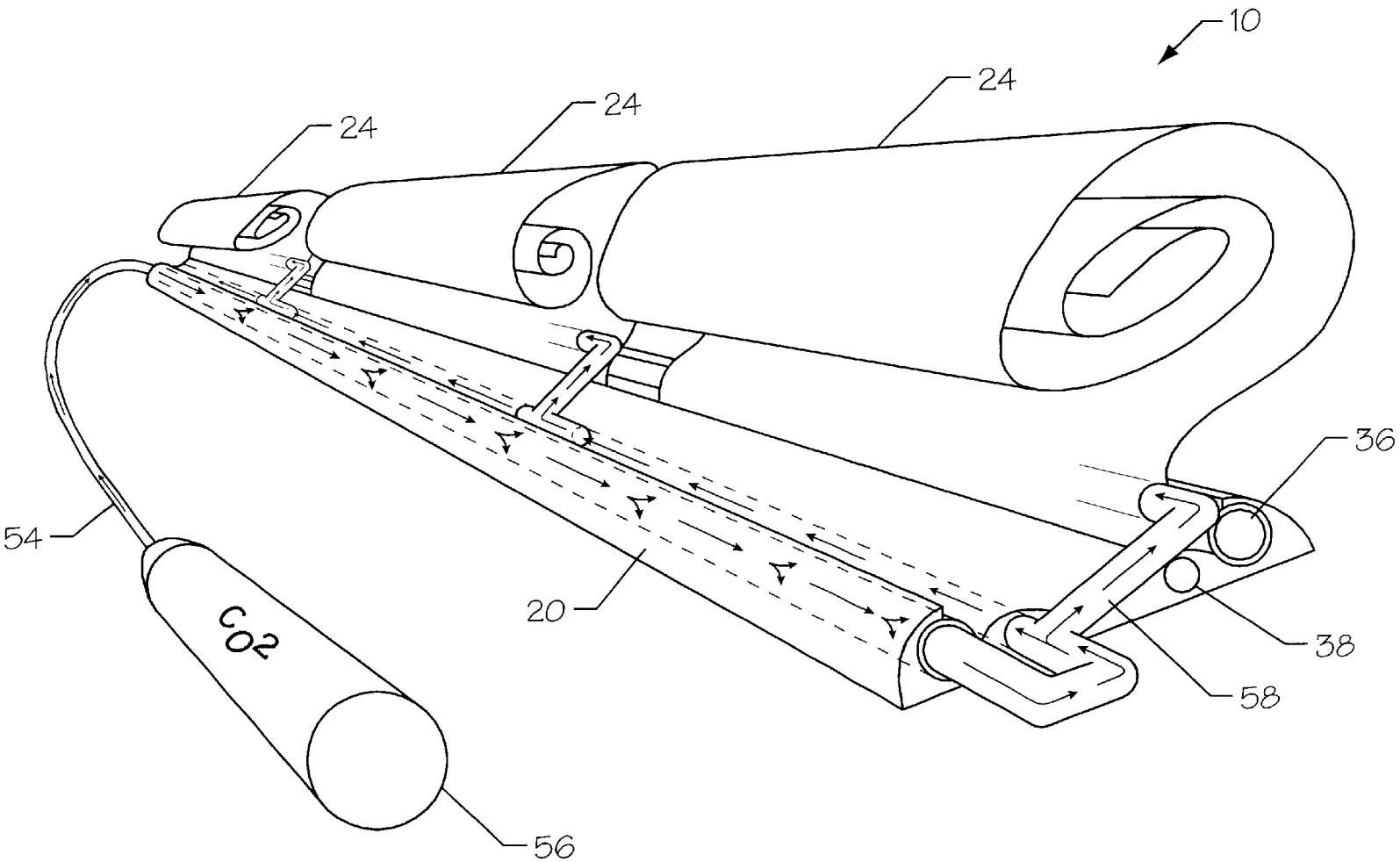
FIG. 6 is a perspective view illustrating the flotation device of FIG. 3, constructed in accordance with the present invention, with the bladder of the flotation device starting to inflate.
Figure 7B:
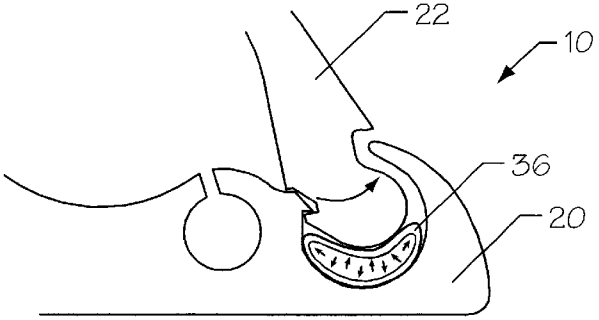
FIG. 7*b* is a sectional view illustrating the flotation device of FIG. 7*a* with the inflatable tubing being partially inflated.
Figure 7D:
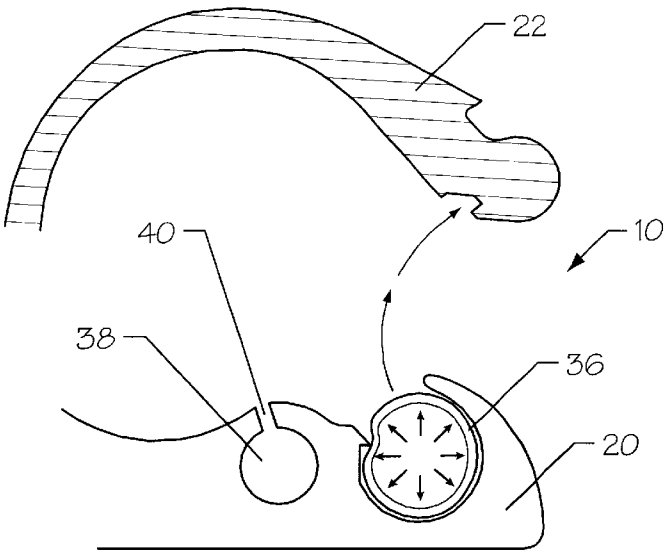
FIG. 7*d* is a sectional view illustrating the flotation device of FIG. 7*a* with the inflatable tubing being completely inflated and one side of the cover moving away from the carrier.
Figure 7A:
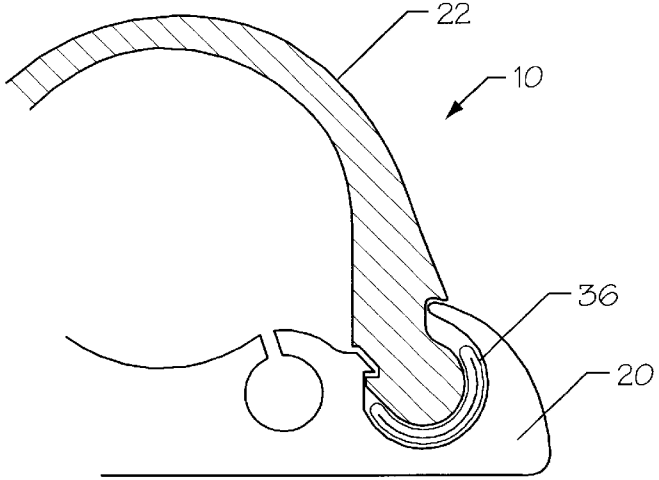
FIG. 7*a* is a sectional view illustrating another embodiment of the flotation device, constructed in accordance with the present invention, with an inflatable tubing positioned between the cover and the carrier.
Figure 7C:
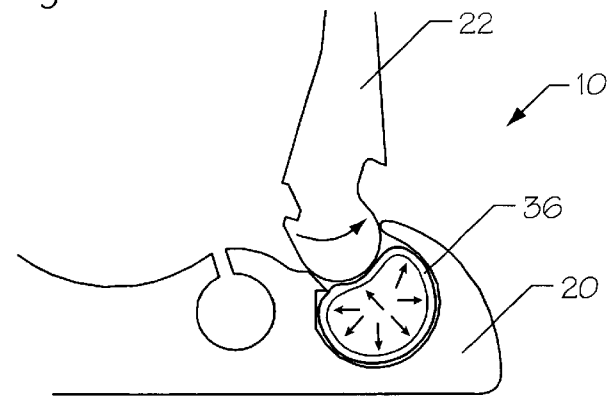
FIG. 7*c* is a sectional view illustrating the flotation device of FIG. 7*a* with the inflatable tubing being substantially inflated.
Figure 7E:
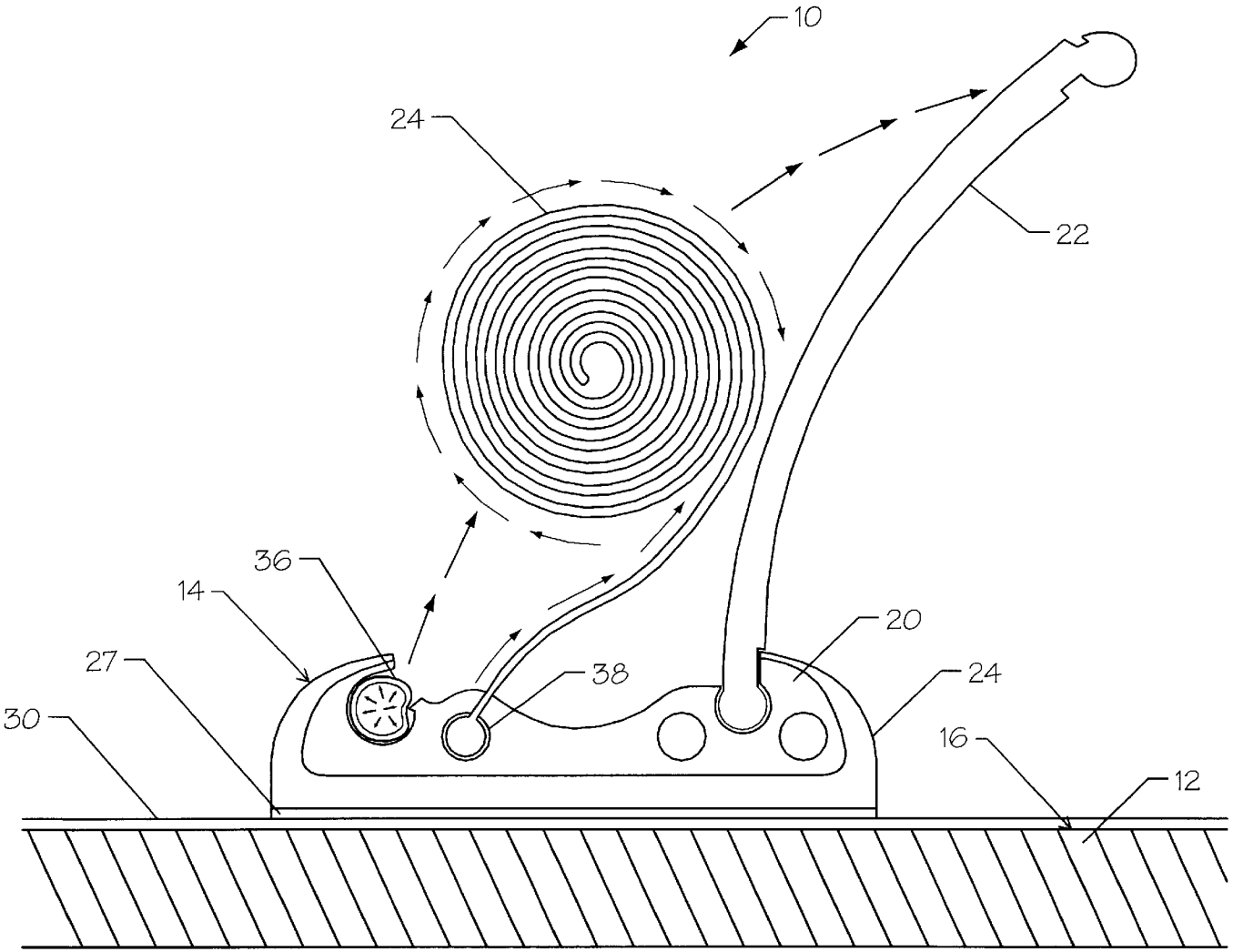
FIG. 7*e* is a sectional view illustrating the flotation device of FIG. 7*d* with the inflatable tubing being completely inflated and the flotation bladder being stored in spiral condition.
Figure 7F:
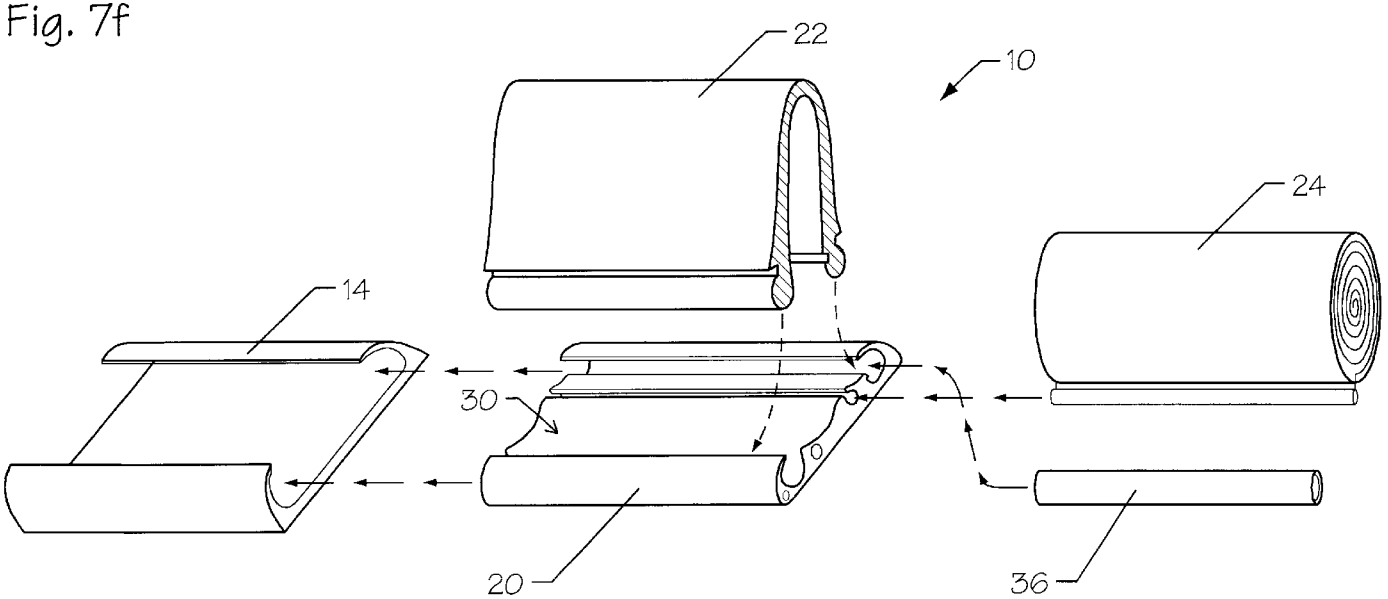
FIG. 7*f* is an exploded assembly view illustrating the flotation device of FIG. 7*a;*
Figure 7G:
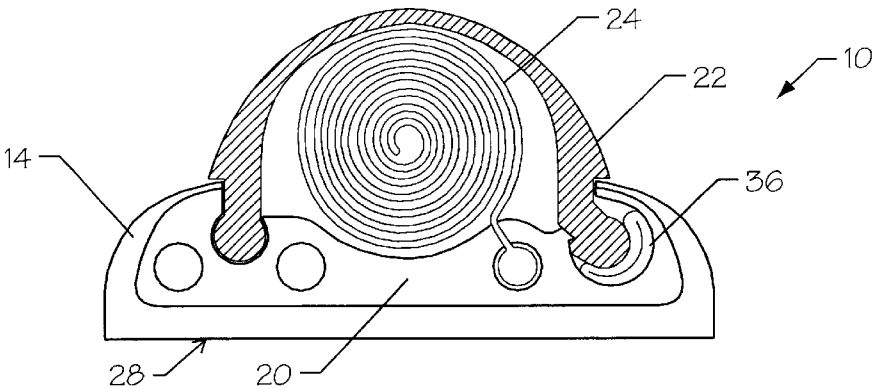
FIG. 7*g* is a sectional view illustrating the flotation device of FIG. 7*f* in a completely assembled condition.
Figure 8:
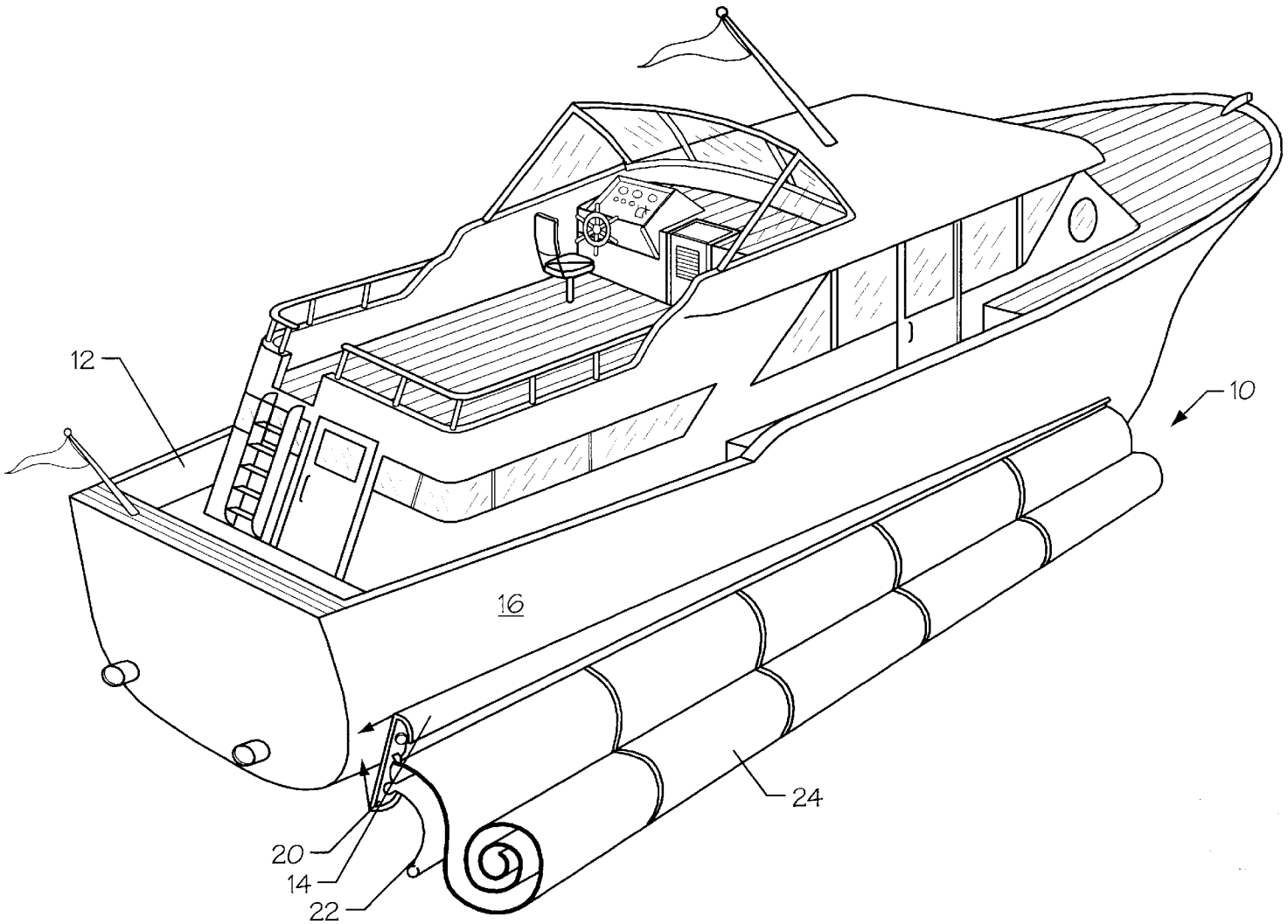
FIG. 8 is a perspective view illustrating the flotation device of FIG. 7, constructed in accordance with the present invention, with the flotation bladder of the flotation device starting to inflate.

When the cover 22 is to be removed so that the bladder 24 can be inflated, compressed gas is released from the gas supply 56 and flows through the supply tubing 54 to the cover tubing 36. As illustrated in FIG. 6, the cover tubing 36 expands, filling the channels 32, 34, forcing the hooked edges 50, 52 out of the channels 32, 34, and removing the cover 22 from the carrier 20. In an alternative embodiment, as illustrated in FIGS. 7 and 8, the cover tubing expands, filling the channel 32, and removing one side of the cover 22 from the carrier 20. The cover 22 remains connected to the carrier 20 in the other channel 32 and swings out of the way of expanding flotation bladder 24.

Referring next to FIG. 6, at the opposing end from the attachment to the supply tubing 54, the cover tubing 36 is attached to the bladder fill tubing 58. The bladder fill tubing 58 attaches to each flotation bladder 24 via a one-way flow valve (not shown). Such one-way valves are known in the art and are, therefore, not described in detail. After the cover tubing 32, 34 has inflated, removing either one side of the cover 22 or both sides of the cover 22, the inert gas will flow in the inflation bladders 24, inflating the inflation bladders 24.

Figure 9:
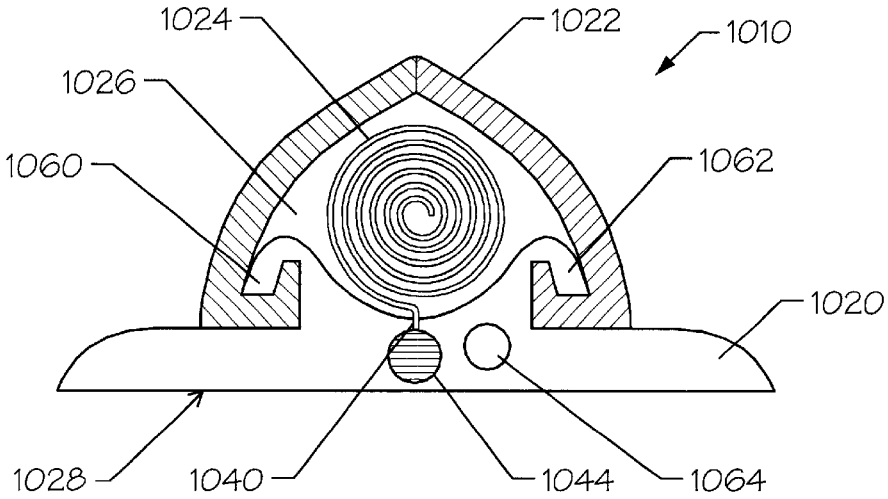
FIG. 9 is a sectional view illustrating still another embodiment of the flotation device, constructed in accordance with the present invention.

As shown in FIG. 9, an alternate embodiment, of the flotation device 1010 includes a carrier 1020, a cover 1022, and a deflated flotation bladder 1024. The flotation bladder 1024 is folded to fit inside space 1026 formed between the carrier 1020 and the cover 1022. The preferred embodiment of the flotation bladder 1024 is rolled into a spiral.

This embodiment of the flotation device 1010 does not include a mounting plate with the carrier 1020 mounted directly to the watercraft hull 1016 (not shown in this embodiment). The carrier 1020 has the flat mounting surface 1028 on one side. The mounting surface 1028 is mounted to the attachment surface 1030 (not shown in this embodiment) on the exterior of the watercraft hull 1016 using either adhesive, as described above, for fiberglass or metal hulls or screws for wood hulls (not shown). Screws might be necessary on wooden hulled boats because any adhesive would only stick to the outermost layer of paint on the exterior of the hull 1016.

Figure 10:
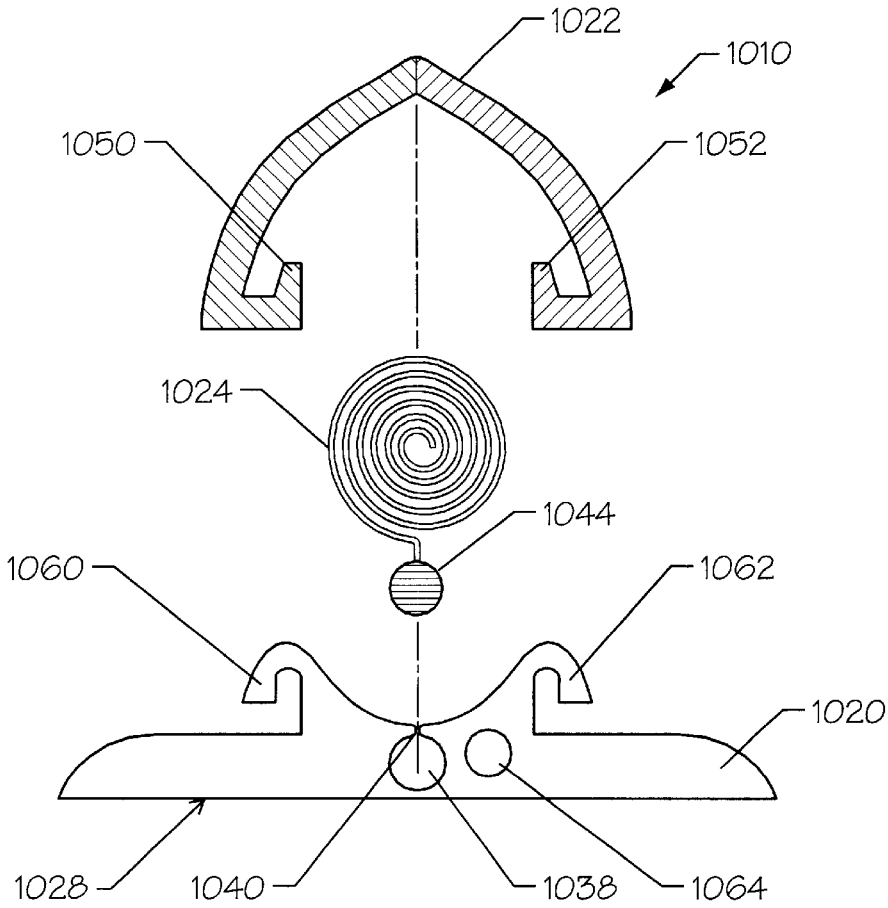
FIG. 10 is an exploded sectional view illustrating the flotation device of FIG. 9, constructed in accordance with the present invention.

The carrier 1020 includes two hooked ridges 1060, 1062 spaced apart from each other and extending axially along the length of the carrier 1020. In the preferred embodiment of this alternate embodiment shown in FIG. 10, the hooked ridges 1060, 1062 face outward from each other. A bladder retaining slot 1038 extends axially along the carrier 1020 between the ridges 1060, 1062. The bladder retaining slot 1038 has a narrowed neck 1040 at the top of the bladder retaining slot 1038. In the preferred embodiment, the bladder retaining slot 1038 is substantially circular and about ½ inch in diameter. As with the previous embodiments, the bladder retaining slot 1038 can have a larger diameter for retaining larger bladders required for heavier watercraft.

The flotation bladder 1024 has one side with an enlarged edge 1044 along the length of the of the flotation bladder 1024 as shown in FIG. 16 and in cross section in FIG. 18. The enlarged edge 1044 fits inside the bladder retaining slot 1038 and is held in place by a rod or rope and the neck 1040 as shown in FIG. 9. The enlarged edge 1044 is slid along the bladder retaining slot 1038, attaching the flotation bladder 1024 to the carrier 1020. The carrier 1020 additionally has a hole 1064 extending along the length of the carrier 1020. The hole 1064 allows gas to flow to the flotation bladders 1024.

The cover 1022 has an interior surface 1046, an exterior surface 1048, and tow hooked edges 1050, 1052 extending axially along the length of the cover 1022. The hooked edges 1050, 1052 are shaped to engage the hooked ridges 1060, 1062 on the carrier 1020. The cover 1022 is attached to the carrier 1020 by fitting the hooked edges 1050, 1052 to the hooked ridges 1060, 1062 as shown in FIG. 9.

Figure 11:
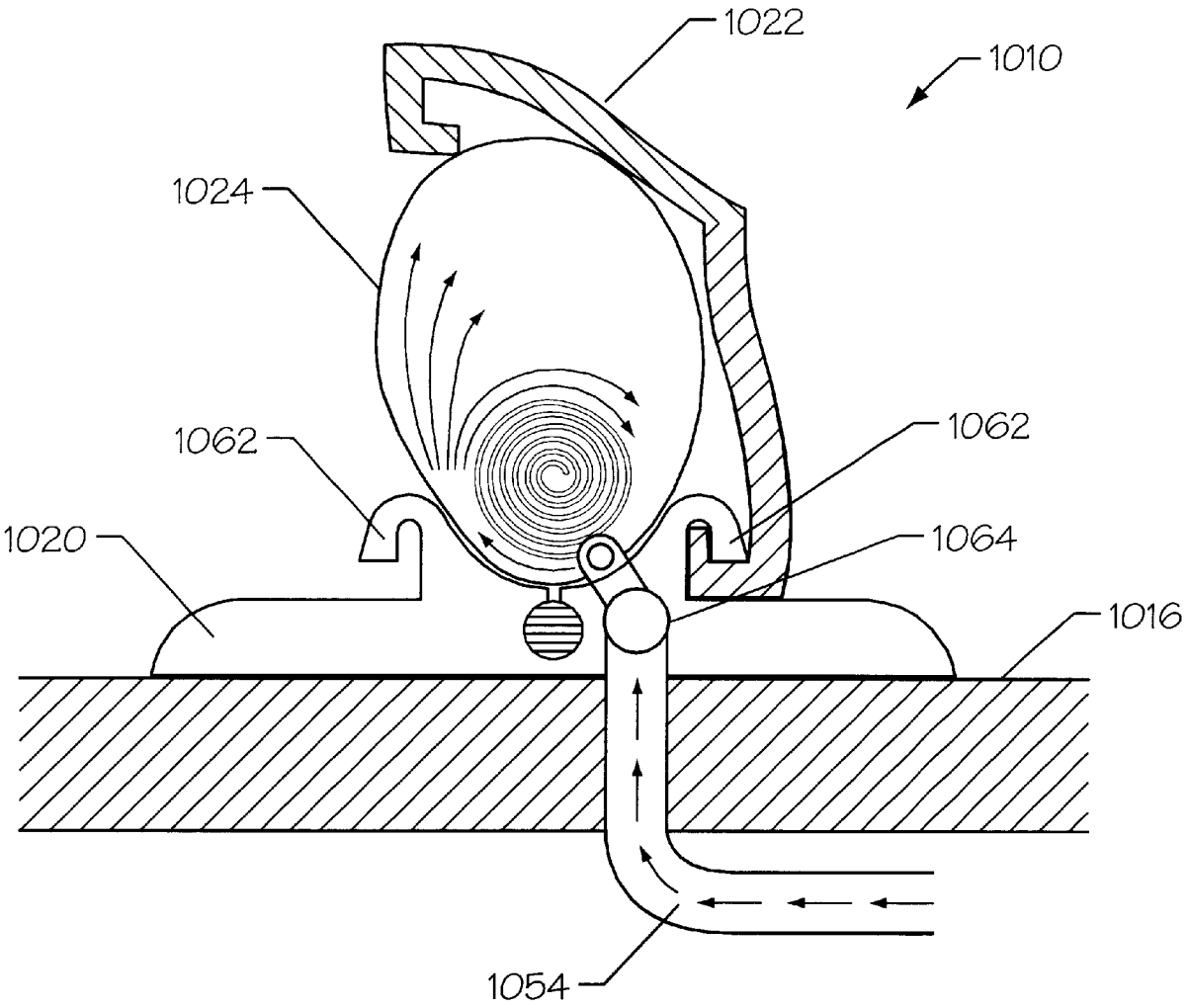
FIG. 11 is a sectional view illustrating the flotation device of FIG. 9, constructed in accordance with the present invention, with the bladder of the flotation device starting to inflate.

To inflate the flotation bladder 1024 in the alternate embodiments, the supply tubing 1054 extends into the hole 1064 and attaches to the flotation bladder 1024 with the valve 1066. The compressed gas is fed into the flotation bladder 1024 and starts to expand the flotation bladder 1024 as shown in FIG. 11. When the flotation bladder 1024 starts to inflate the cover 1022 is forced off the hooked ridges 1060 and/or 1062. The cover 1022 drops free and does not interfere with the inflation of the flotation bladder 1024. It is important that the cover 1022 be made from a material that is stiff enough to remain in position under normal circumstances, yet is flexible enough to allow the cover 1022 to disengage from the carrier 1020.

Figure 12:
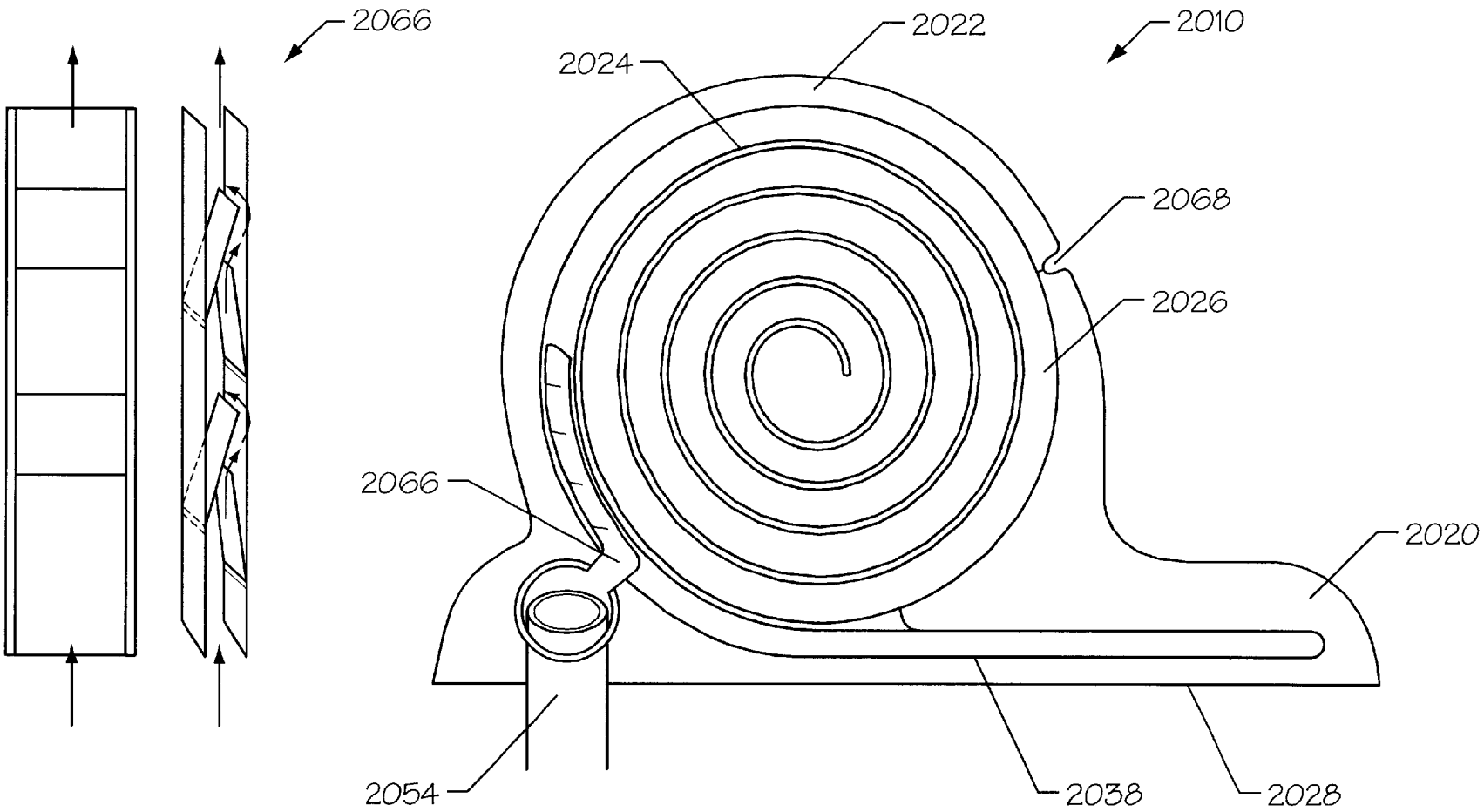
FIG. 12 is a sectional view illustrating still another embodiment of the flotation device, constructed in accordance with the present invention.

Another alternate embodiment of the flotation device 2010 is illustrated in FIG. 12. The carrier 2020 and the cover 2022 are formed as one piece. This embodiment of the flotation device 2010 does not include a mounting plate with the carrier 2020 mounted directly to the watercraft hull 2016 (not shown in this embodiment). The carrier 2020 has the flat mounting surface 2028 on one side. The mounting surface 2028 is mounted to the attachment surface 2030 (not shown in this embodiment) on the exterior of the watercraft hull 2016 using either adhesive, as described above, for fiberglass or metal hulls or screws for wood hulls (not shown). Screws might be necessary on wooden hulled boats because any adhesive would only stick to the outermost layer of paint on the exterior of the hull 2016.

A flotation bladder 2024 is folded inside the carrier 2020 in the space 2026. The flotation bladder 2024 is attached to the carrier 2020 at the bladder retaining slot 2038. On the cover 2022, there is an opening point 2068. The opening point 2068 can either be a weakened point in the cover 2022 or detonation cord.

Figure 13:
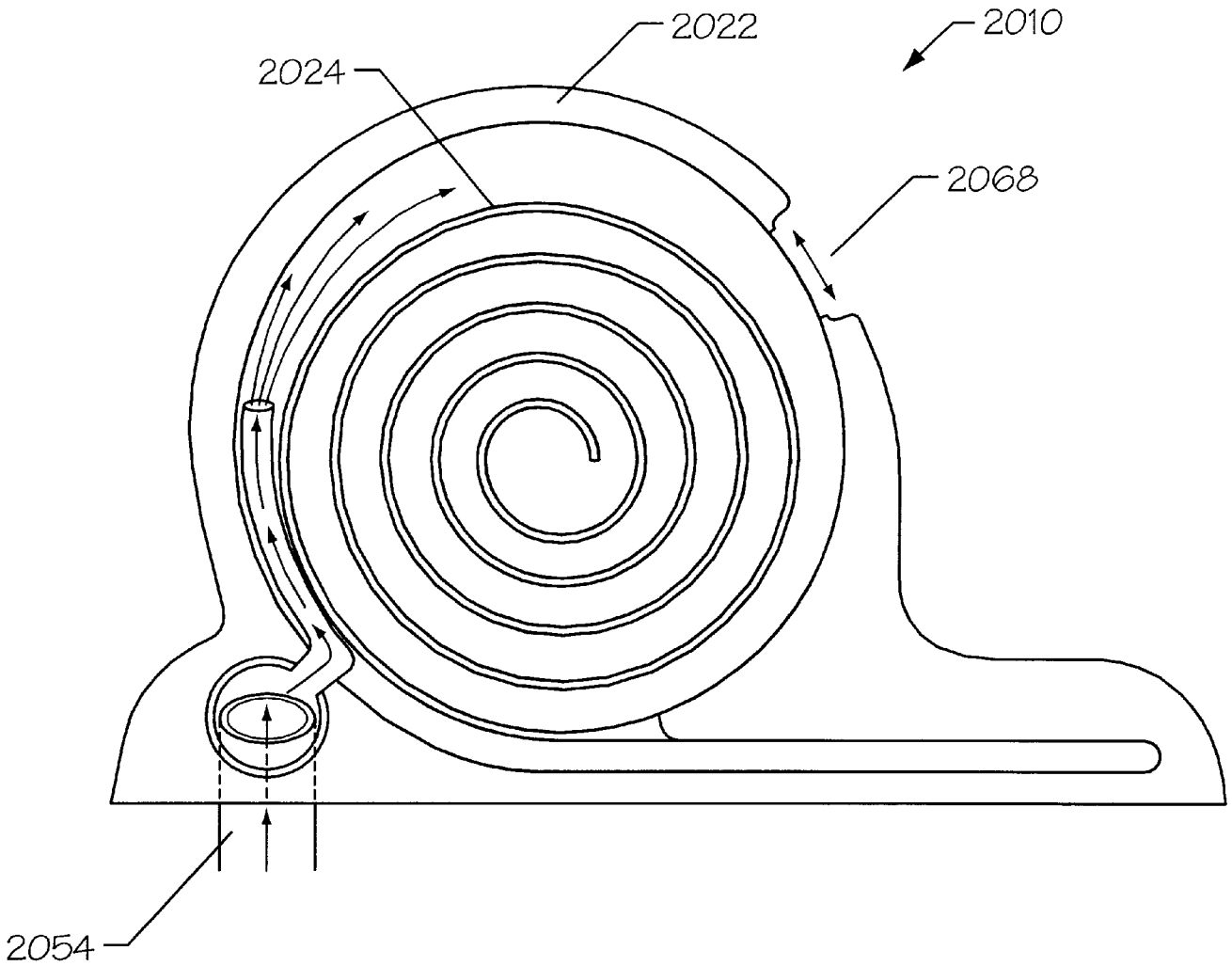
FIG. 13 is a sectional view illustrating the flotation device of FIG. 12, constructed in accordance with the present invention, with the bladder of the flotation device starting to inflate.
Figure 14:
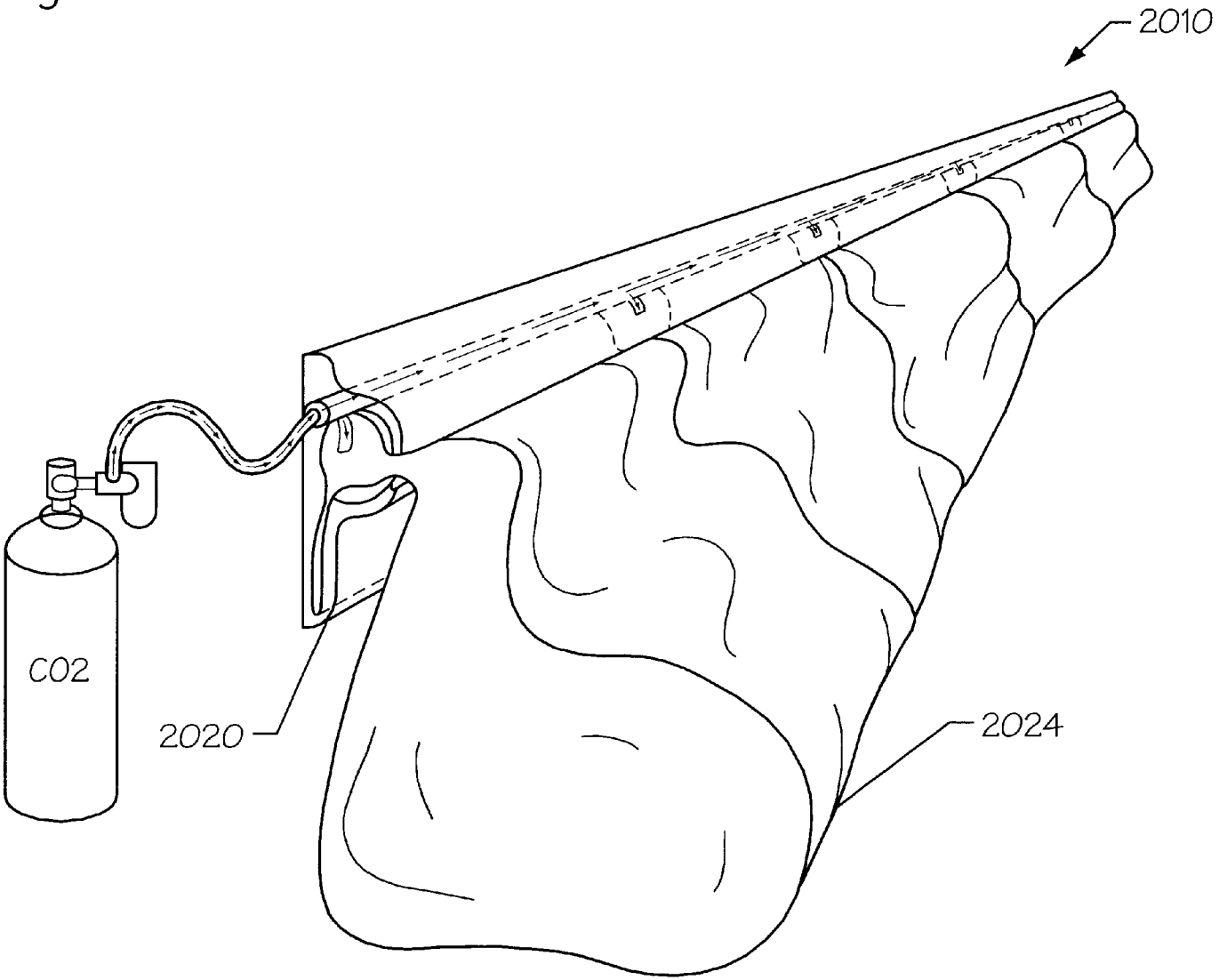
FIG. 14 is a perspective view illustrating the flotation device of FIG. 12, constructed in accordance with the present invention, with the bladder of the flotation device inflating.

A valve 2066 is attached to the flotation bladder 2024 and to the supply tubing 2054. When the flotation bladder 2024 is inflated the cover 2022 is opened along the opening point 2068. The opening point 2068 is opened either by exploding the detonation cord or the pressure of the expanding flotation bladder 2024 breaks the cover 2022 alone the weakened point as shown in FIGS. 13 and 14.

Figure 15:
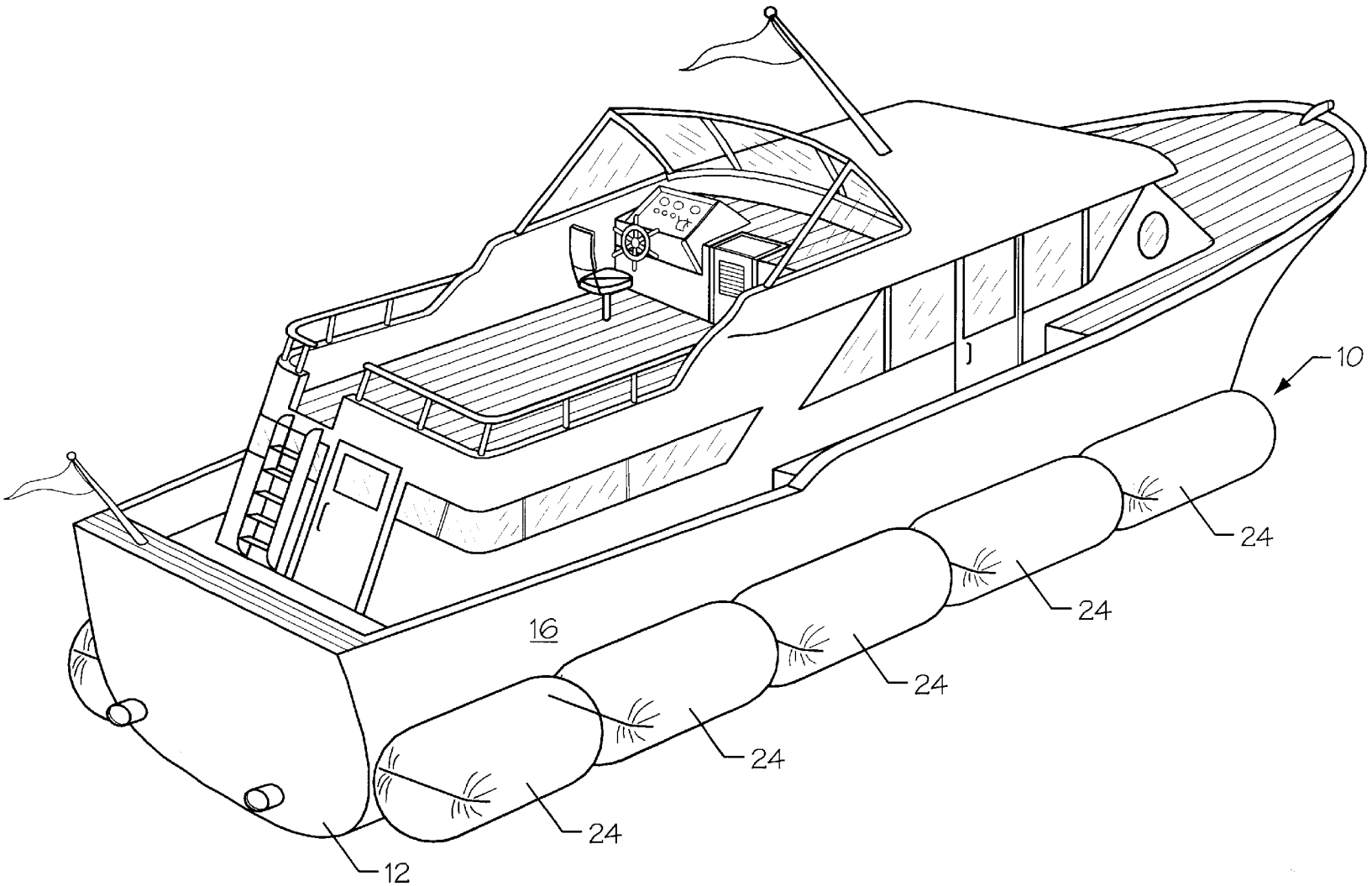
FIG. 15 is a perspective view illustrating the flotation device mounted on the watercraft with the flotation bladders being fully inflated.

FIG. 15 illustrates a watercraft 12 with the preferred embodiment of the flotation bladders 24 mounted to the exterior of the hull 16. The flotation bladders 24 are fully inflated. The preferred embodiment of the flotation bladders 24 are single bladders that are each a given length and are attached to carrier 20 individually. FIG. 17 illustrates a fully inflated individual flotation bladder 24.

Figure 19:
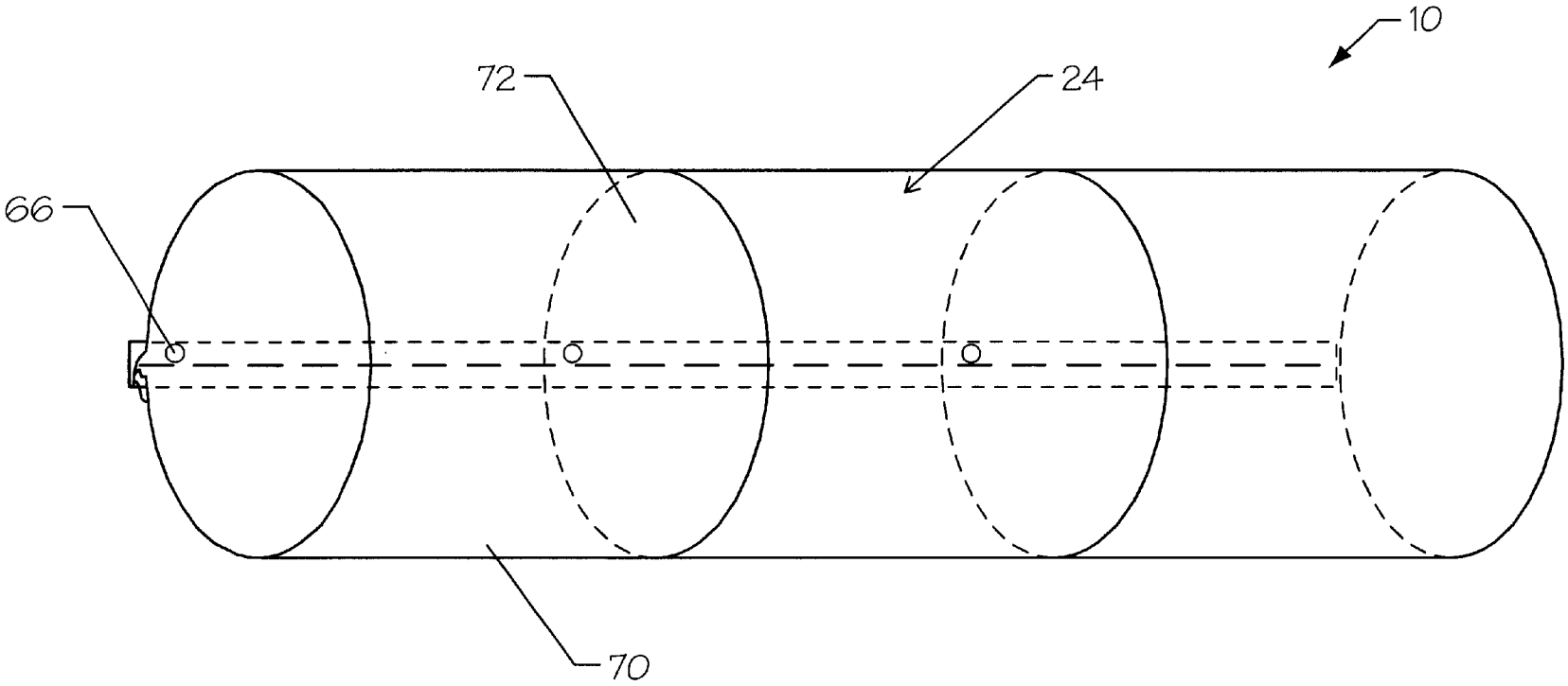
FIG. 19 is a perspective view illustrating another embodiment of the flotation bladder with internal chambers.
Figure 20:
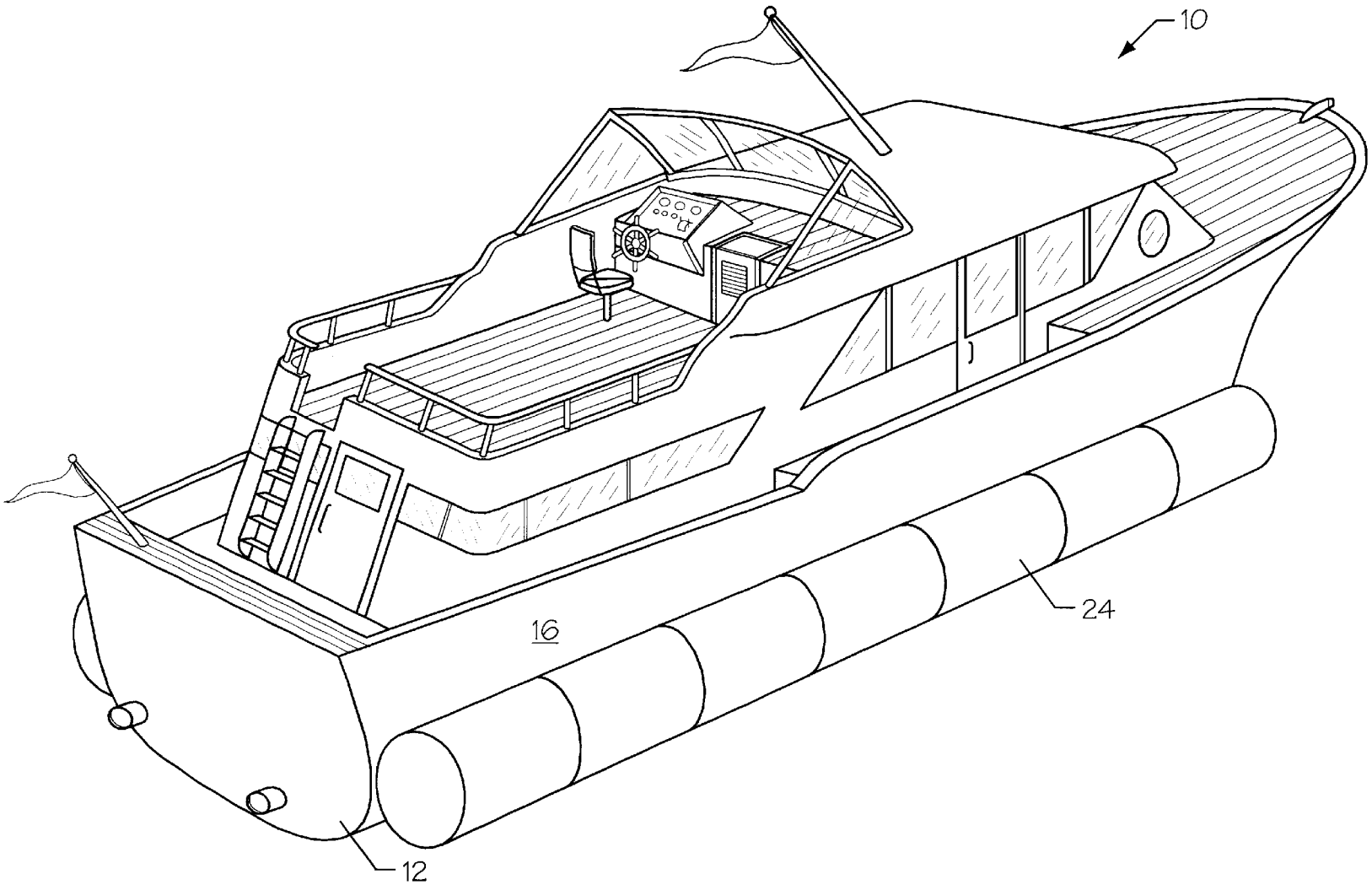
FIG. 20 is a perspective view illustrating a watercraft with the embodiment of the flotation bladders of FIG. 19 being fully inflated.

An alternate embodiment of the flotation bladder 24 is illustrated fully inflated in FIG. 19. The flotation bladder 24 has internal chambers 70 separated by internal walls 72. A valve 66 feeds each internal chamber 70.

Either type of the flotation bladder 24 can be used with any of the embodiments of the flotation device 10. The plurality of inflation bladders 24 are the preferred embodiment because it is easier to manufacture and makes the flotation device 10 easier to mount on a variety of watercraft. The flotation bladders 24 are manufactured in a given length and the needed numbers of bladders are put along the length of the hull 16.

The carrier 20 of each embodiment is made from a semi-rigid material, such as UHMW plastic. The material must be flexible enough to allow the carrier 20 to bend to match the curve of the watercraft hull 16. However, the material must to be rigid enough so that the inflation of the flotation bladder 24 will not dislodge the enlarged edge 44 from bladder retaining slot 38.

The cover 22 must be made from a durable material including, but not limited to, thermal plastic rubber, as it is going to be exposed to the elements continuously. When the carrier 20 is mounted on the hull 16 of the watercraft 12 and the cover 22 is in place, the present invention functions as a bumper to protect the watercraft 12.

Figure 21:
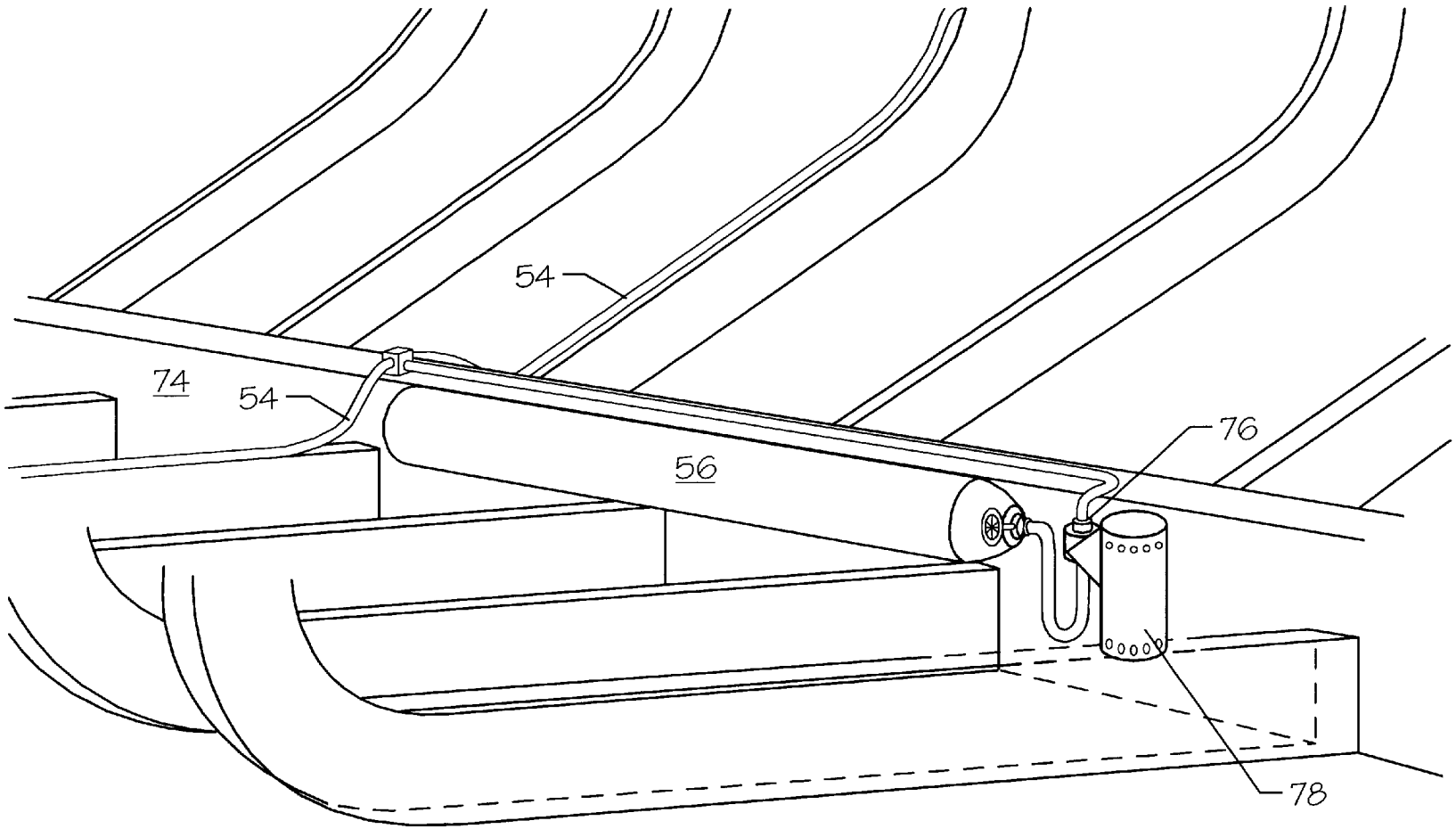
FIG. 21 is a perspective view illustrating the inside of the watercraft hull with the compressed gas cylinder and the valve actuator mounted to the hull of the watercraft and connected to the rail with tubing.
Figure 30:
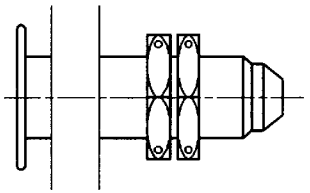
FIG. 30 is a side elevational view illustrating the bulkhead fitting for connecting the flotation device with the gas supply.
Figure 31:
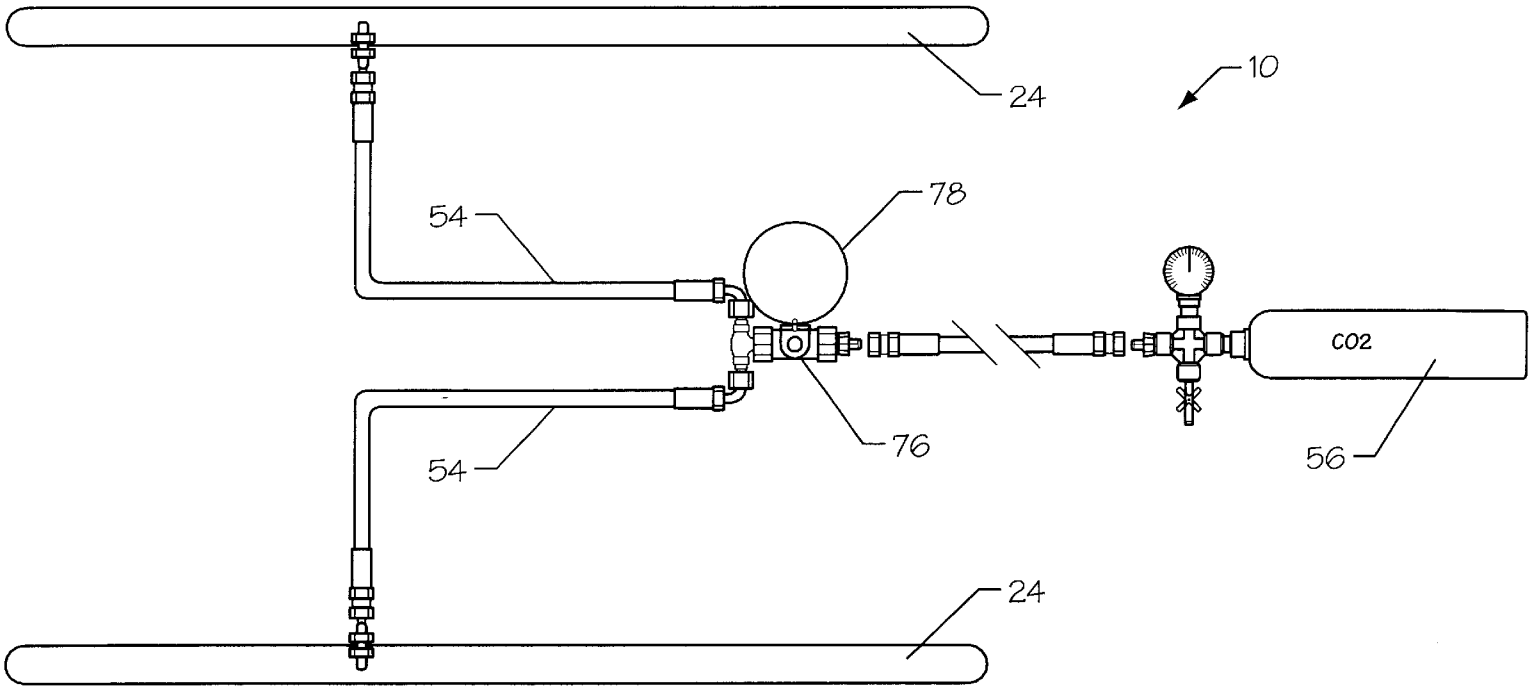
FIG. 31 is a plan view illustrating the connection between the gas supply, the float switch, and the flotation device.

FIG. 21 illustrates the gas supply 56 mounted on the inside 74 of the hull 16 of the watercraft 12. The gas supply 56 is attached to the supply tubing 54 via a valve 76 which is activated by a float switch 78. The supply tubing 54 and all fittings are made from stainless steel or silicone rubber tubing. In the preferred embodiment, the supply tubing 54 is drawn seamless hydraulic line tubing, 0.375" I.D. A watertight bulkhead connection, as illustrated in FIGS. 30 and 31, will penetrate through the boat hull in two (2) places to route the supply tubing 54 from the inside of the hull 16 out to a connection to the cover tubing 36 and the flotation bladders 24. The float switch 78 in the preferred embodiments is located on the side of the hull 16 at a height h1 selected so that the float switch 78 actuates when the hull 16 is filled with enough water to lower the watercraft 12 about two (2") inches below the designed waterline for that particular watercraft 12. The float switch 78 preferably activates when the float 127 rises approximately two (2") inches within the float body 103.

Figure 23:
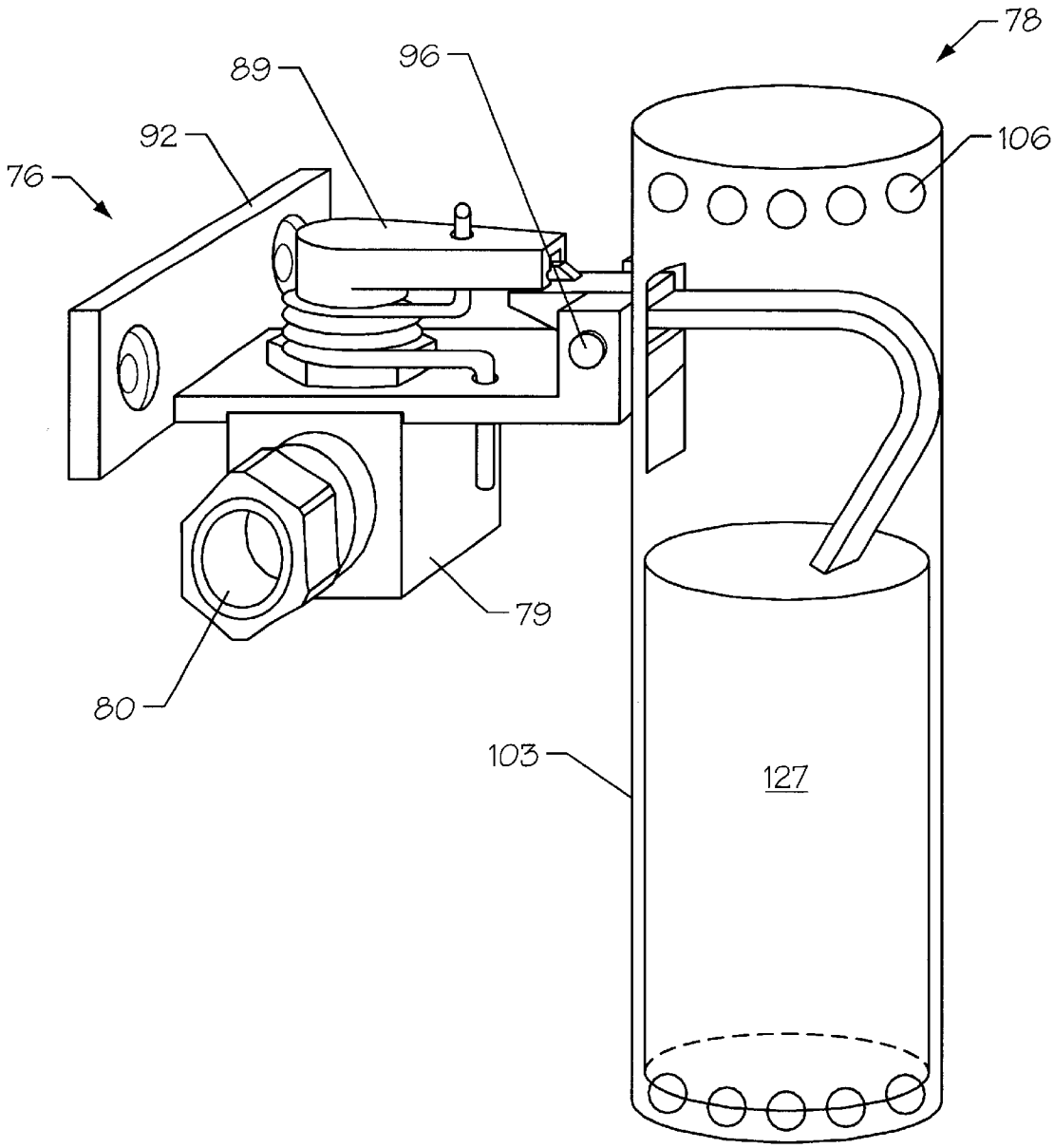
FIG. 23 is a perspective view illustrating the valve and the float switch of FIG. 22 in the off positions.
Figure 24:
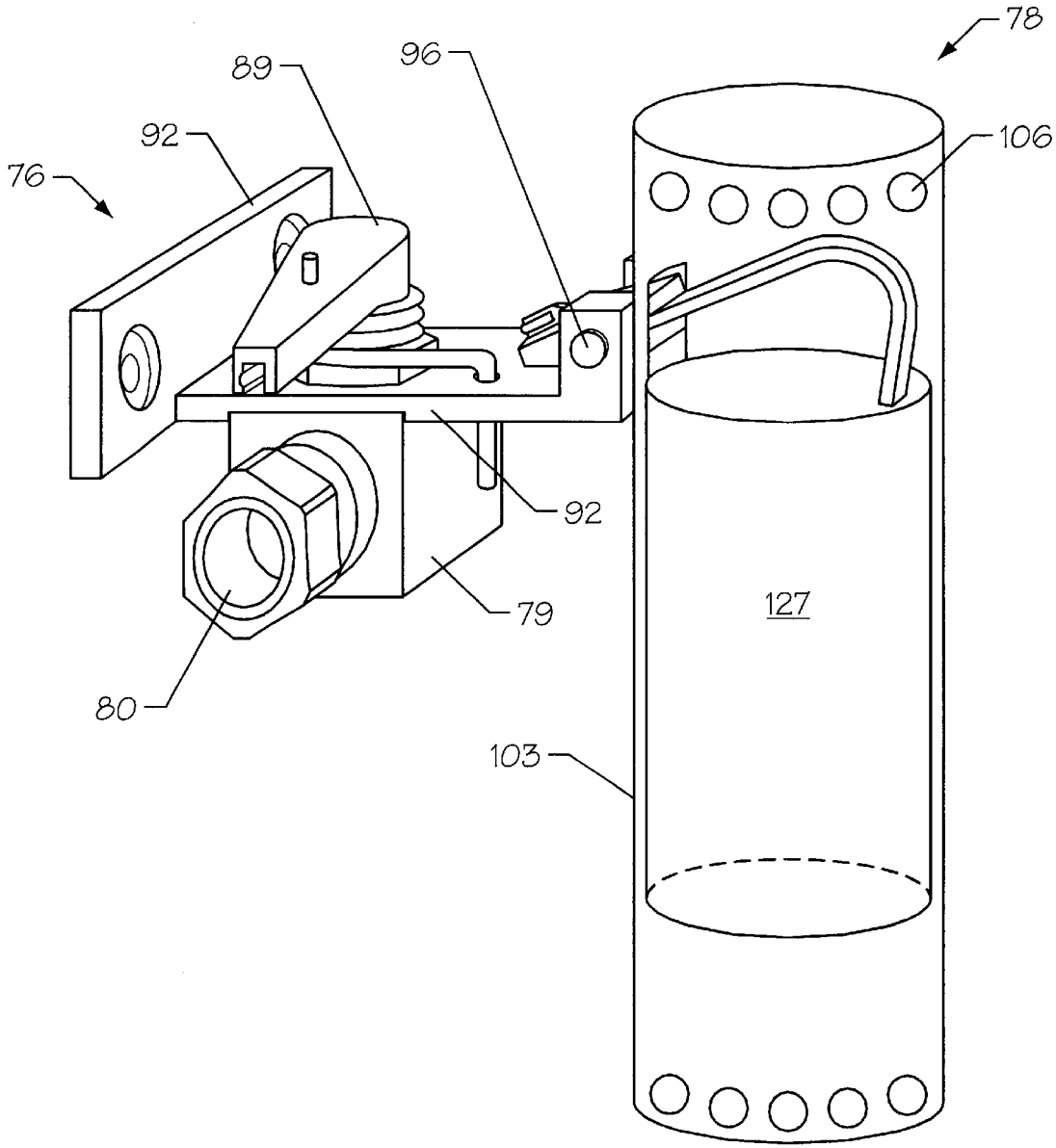
FIG. 24 is a perspective view illustrating the valve and the float switch in the on positions.

A partially exploded view of the valve 76 and the float switch 78 is illustrated in FIGS. 23 and 24. The valve body 79 is a standard stainless steel ball valve and in the preferred embodiment the valve body 79 is manufactured by the Nupro Corporation. The valve body 79 has an inlet 80, an outlet 82, a threaded attachment post 84, and a valve stem 86 which controls if the valve 76 is open or closed. An attachment plate 88 is threaded down over the attachment post 84 to rest on the top 90 of the valve body 79. A nut 91 secures the attachment plate 88 to the valve body 79 by threading on to the attachment post 84.

The attachment plate 88 has a mounting plate 92 attached to one end to allow the valve 76 to be mounted to the boat hull 16. Also part of the attachment plate 88 is a pivot mount 93. In the preferred embodiment, the pivot mount 93 is formed of two holders 94*a*, 94*b* with pivot holes 95*a*, 95*b*, respectively. A pivot rod 96 slides into pivot hole 95*a*, 95*b*. A retaining hole 97 is provided in the attachment plate 88.

A handle 89 attaches to the valve stem 86 and has a hole 98. A spring 99 fits around the base of the handle 89; and the ends 101*a*, 101*b* of the spring fit in holes 97 and 98, respectively. The spring 99 holds the handle 89 and the attached valve stem 86 in the open position, so that the valve 76 is biased open as shown in FIG. 24.

Figure 22:
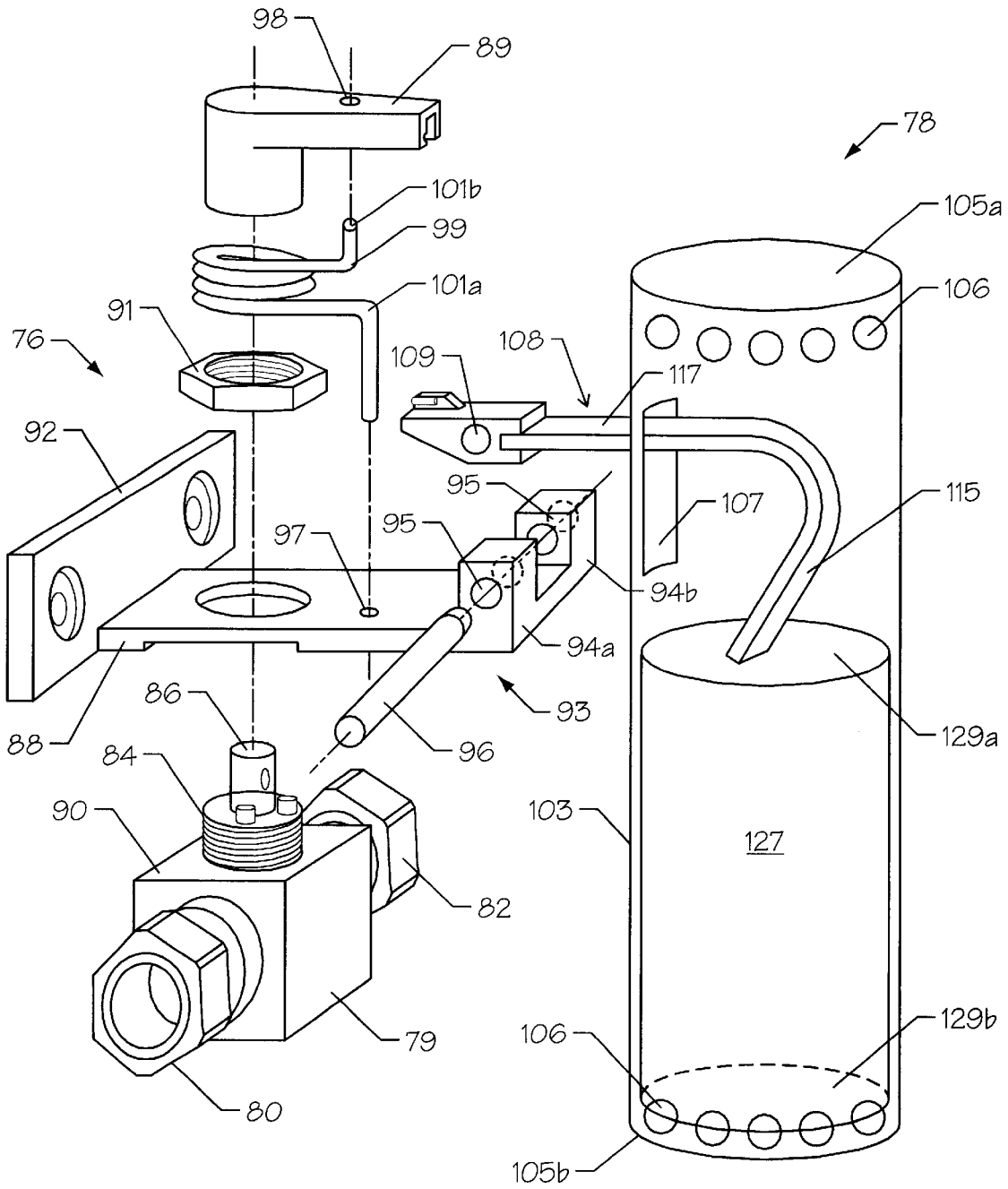
FIG. 22 is an exploded view illustrating an embodiment of the valve and the float switch of the flotation device, constructed in accordance with the present invention.

As shown in FIG. 23, the float switch 78 is releasably attached to the handle 89 to hold the valve 76 in the closed position. The float switch 78 has a body 103, shown partially cutaway in FIGS. 22, 23, and 24. The body 103 is a hollow shell having a top and bottom end 105*a*, 105*b*, respectively, which are closed. Water flow holes 106 are placed around both ends to allow water to flow freely in and out of the body 103.

On one side the body 103 has a hole 107. A float arm 108 extends through the hole 107 from inside the body 103 to the outside. The float arm 108 is pivotally attached at pivot point 109 to the pivot mount 93 with pivot rod 96. The float arm 108 has a trigger end 115 has a generally L shaped appearance. The L-shaped bend of the trigger is designed to center the interface between the arm and the float and provide better mechanical advantage for the float to release the trigger.

Figure 26:
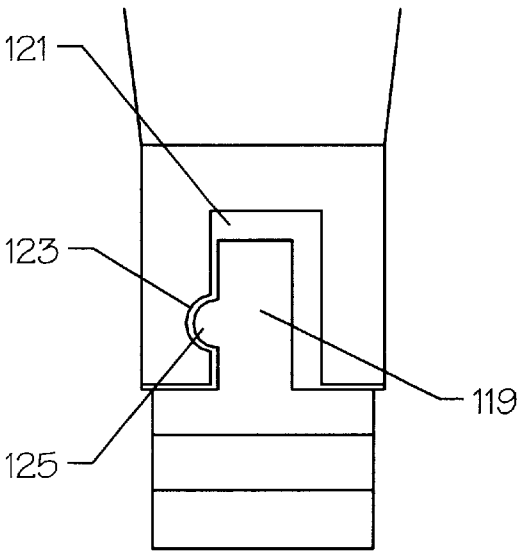
FIG. 26 is sectional view illustrating the interlock taken along line 21—21 in FIG. 21.
Figure 25:
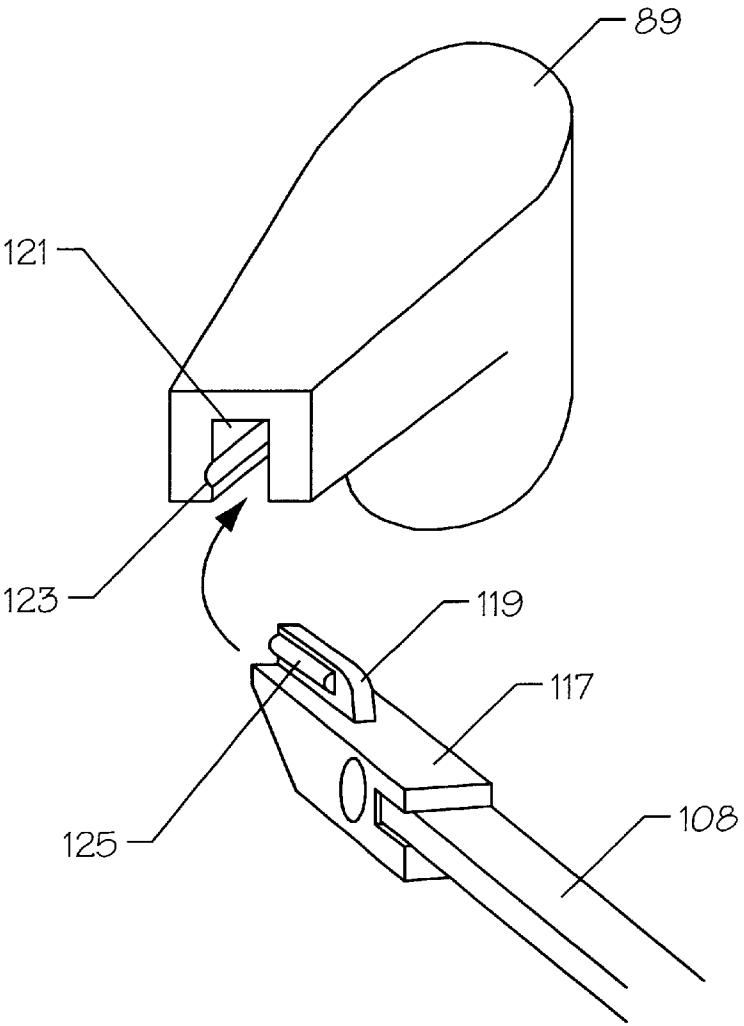
FIG. 25 is a perspective view illustrating the interlock between the float switch and the valve switch.

As shown in FIG. 25, the attachment end 117 has a blade 119 which fits inside a channel 121 inside the handle 89. The channel 121 has a safety groove 123 running along one side. A bead 125 on the blade 119 fits into the safety groove 123 as shown in cross-section in FIG. 26. This blade 119 and the bead 125 form a releasable attachment between the handle 89 and the float arm 108 when the float arm 108 is attached to the handle 89 biasing the valve 76 open, as shown in FIG. 23.

The placement of the pivot point 109 close to the attachment end 117 means that with no support of the float arm 108, the attachment end 117 pivots up against the handle 89, pressing the blade 119 firmly up in to the groove channel. To release the handle 89 and trigger the spring 99 to bias the valve 76 open, the float arm 108 must be pivoted so that the blade 119 pulls down out of the channel 121, releasing the handle 89. The bead 125 and the safety groove 123 are a safety mechanism to insure that vibration alone will not set off the trigger mechanism. When the handle 89 is in the closed position as shown in FIG. 23 this is the safe mode for the valve.

The trigger end 115 rests on a top 129*a* of a float 127. The float 127 is made from closed cell polystyrene in the preferred embodiment. The float 127 is sized to snugly fit inside the body 103 so that it will not move up and down inside the body from gravity alone. The float 127 nominally requires at least one pound of force to move although setting the float 127 to another predetermined amount of force is within the scope of the present invention. The bottom end 129*b* of the float 127 is set so that it is just above the line of water flow holes 106 on the bottom edge of the body 103 in the safe mode.

If a rupture of the hull occurs then water will start to fill the inside of the hull 16. As the water reaches the base of the float switch 78, the water will flow into the flow holes 106. The water will cause the float 127 to rise inside the body 103. The float 127 is fit inside the body 103 tight enough that only the continuous presence of water will provide enough force for the float 127 to rise. Water splashing into the holes 106 due to rough seas will not cause the float 127 to rise. As the float 127 rises it pushes the trigger end 115 of the float arm 108 upward, causing the attachment end 117 downward as shown in FIG. 24. This pulls the blade 119 out of the channel 121 and releases the compressed gas to fill the cover tubing 36 and then the flotation bladder 24 is inflated through a check valve (not shown). The deflated bladder 24 can then be removed by pulling the enlarged edge 44 of the flotation bladder 24 along the bladder retaining slot 38 to the end of the carrier 20 as shown in FIG. 5. Then the flotation bladder 24 can be re-rolled and replace or a new flotation bladder 24 can be re-mounted in the bladder retaining slot 38 and the cover 22 replaced.

Figure 28:
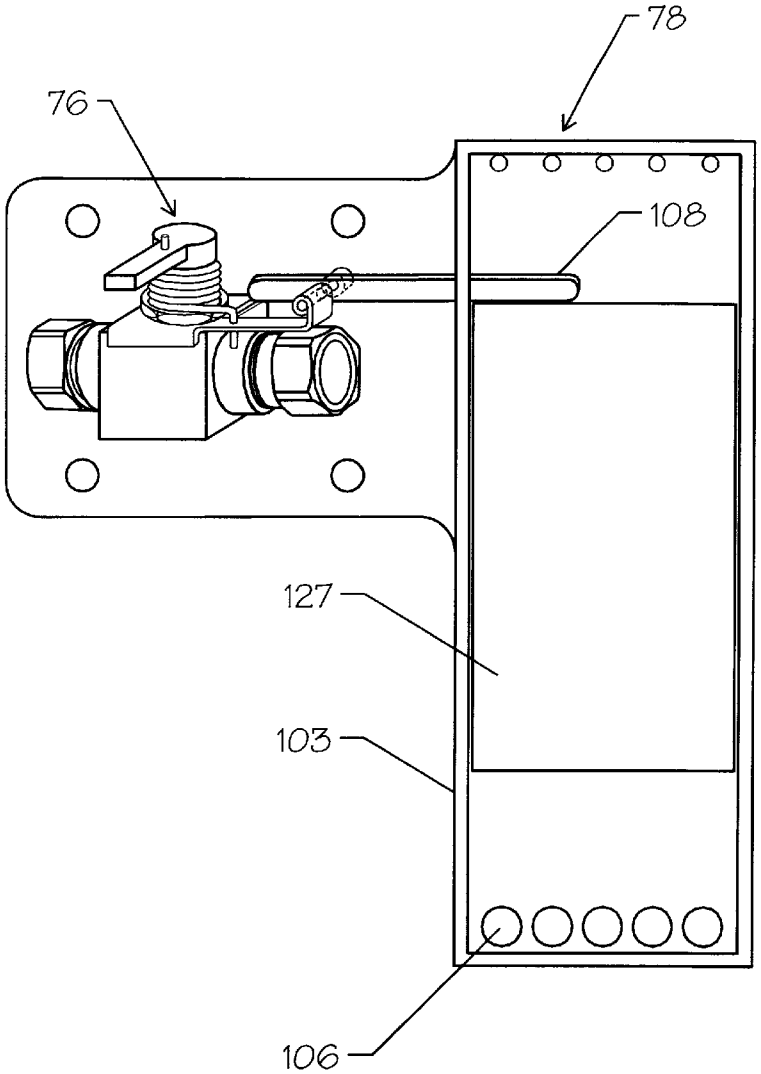
FIG. 28 is a side view illustrating the valve and float switch of FIG. 27, constructed in accordance with the present invention, with the valve and float switch being in the on position.
Figure 27:
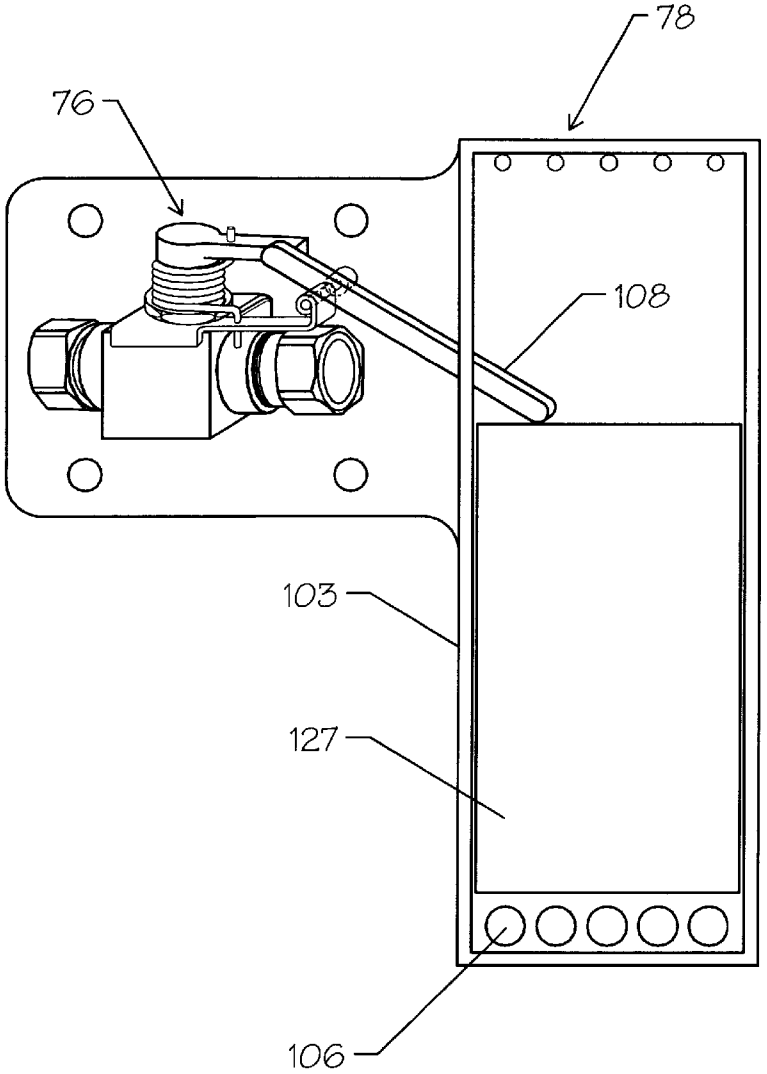
FIG. 27 is a side view illustrating another embodiment of the valve and the float switch of the flotation device, constructed in accordance with the present invention, with the valve and float switch being in the off position.

As illustrated in FIGS. 27 and 28, another valve 76 is illustrated. The valve 76 includes the float switch 78 as described above. The float 127 within the float switch 78 moves upward upon a predetermined amount of water entering the float 127 through the water holes 106. The float 127 moves the float arm 108 to activate the valve 76 to begin inflation of the inflation bladder 24.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A flotation device for maintaining a watercraft in a floating condition, the flotation device comprising:

an elongated housing mountable to the watercraft;

a carrier slidably receivable within the elongated housing, the carrier having a first cover channel, a second cover channel, and a bladder retaining slot;

a first collapsible tubing receivable within the first cover channel;

an elongated cover having a first edge and a second edge, the first edge releasably receivable in the first cover channel and the second edge releasably receivable in the second cover channel;

a space defined between the carrier and the cover;

a flotation bladder receivable within the space, the flotation bladder having a bladder edge receivable in the bladder retaining slot; and inflation means connected to the first collapsible tubing and the flotation bladder for inflating the first collapsible tubing and for inflating the flotation bladder upon inflation of the first collapsible tubing;

wherein upon inflation of the first collapsible tubing, the first edge of the cover is released from the first cover channel of the carrier; and wherein upon inflation of the flotation bladder, the flotation bladder moves the first edge of the cover in a direction generally away from the watercraft allowing the flotation bladder to substantially inflate.

2. The flotation device of claim 1 and further comprising:

a second collapsible tubing receivable within the second cover channel between the second edge of the cover and the carrier;

wherein the inflation means is connected to the second collapsible tubing such that upon inflation of the second collapsible tubing, the second edge of the cover is released from the second cover channel of the carrier.

3. The flotation device of claim 1 wherein the housing is mounted to the watercraft with an adhesive material.

4. The flotation device of claim 1 wherein the housing is mounted to the watercraft at the approximate waterline of the watercraft.

5. The flotation device of claim 1 and further comprising:

trigger means for automatically activating the inflation means.

6. The flotation device of claim 5 wherein the trigger means comprises a float switch activating a valve upon a predetermined amount of water entering the watercraft, the valve connected to the inflation means for activating the inflation means.

7. The flotation device of claim 6 wherein the float switch includes a hollow body slidable within a hollow shell, the hollow shell having at least one hole for receiving water entering the watercraft.

8. The flotation device of claim 7 and further comprising:

a float arm contacting the hollow shell and pivotally connected to the valve.

9. The flotation device of claim 1 wherein the inflation means is a gas supply having a gas under pressure.

10. The flotation device of claim 1 wherein the flotation bladder is in a substantially spiral configuration prior to inflation.

11. The flotation device of claim 1 wherein the flotation bladder comprises a plurality of flotation bladders along the waterline of the watercraft, each flotation bladder being independently inflatable.

12. An emergency buoyant support for a watercraft, the emergency buoyant support comprising:

a base plate mounted to the watercraft;

a cover attached to the base plate, the cover having a first cover channel, a second cover channel, and a bladder retaining slot, the cover further having a first edge and a second edge, the first edge releasably receivable in the first cover channel and the second edge releasably receivable in the second cover channel;

a storage channel formed between the base plate and the cover;

an inflatable bladder spirally wrapped within the storage channel;

a first collapsible tubing receivable within the first cover channel;

wherein upon inflation of the first collapsible tubing, the first edge of the cover is released from the first cover channel of the base plate; and wherein upon inflation of the inflatable bladder, the inflatable bladder moves the first edge of the cover in a direction generally away from the watercraft allowing the inflatable bladder to substantially inflate.

13. The emergency buoyant support of claim 12 wherein the base plate and the cover are constructed from a unitary piece of material, the cover having at least one opening point, the opening point opening the cover upon inflation of the inflatable bladder.

14. The emergency buoyant support of claim 12 wherein the base plate and the cover are constructed from a unitary piece of material, the cover having at least one opening point, the opening point opening the cover upon detonation of a detonation cord.

15. The emergency buoyant support of claim 12 and further comprising inflation means for inflating the inflatable bladder.

16. The emergency buoyant support of claim 12 and further comprising:

a second collapsible tubing receivable within the second cover channel between the second edge of the cover and the base plate;

wherein upon inflation of the second collapsible tubing, the second edge of the cover is released from the second cover channel of the base plate.

17. The emergency buoyant support of claim 12 and further comprising:

trigger means for automatically inflating the inflation bladder only upon a predetermined amount of water entering the watercraft.

18. The emergency buoyant support of claim 17 wherein the trigger means is a float switch and a valve, the float switch having a hollow body slidable within a hollow shell, the hollow shell having at least one hole for receiving water entering the watercraft.

19. A method for maintaining a watercraft in a floating condition, the method comprising:

mounting a housing to the watercraft;

sliding and releasably securing a carrier into the housing, the housing having a first cover channel, a second cover channel, and a bladder retaining slot;

positioning a first collapsible tubing within the first cover channel;

covering at least a portion of the carrier with a cover, the cover having a first edge and a second edge;

releasably mounting the first edge of the cover within the first cover channel and the second edge within the second cover channel;

defining a space between the carrier and the cover;

positioning a flotation bladder within the space, the flotation bladder having a bladder edge;

mounting the bladder edge of the flotation bladder within the bladder retaining slot;

inflating the first collapsible tubing; and inflating the inflation bladder.

20. The method of claim 19 and further comprising:

positioning a second collapsible tubing within the second cover channel;

inflating the second collapsible tubing prior to inflating the inflation bladder.

21. The method of claim 19 and further comprising:

mounting the housing to the watercraft with an adhesive material.

22. The method of claim 19 and further comprising:

automatically inflating the first collapsible tubing and the inflation bladder only upon a predetermined amount of water entering the watercraft.

23. The method of claim 19 and further comprising:

spirally rolling the flotation bladder within the opening.

* * * * *